US005208790A

United States Patent [19]

Sato

[11] Patent Number: 5,208,790

[45] Date of Patent: May 4, 1993

[54] ASTRONOMICAL DATA INDICATING DEVICE

[75] Inventor: Hiroshi Sato, Fussa, Japan

[73] Assignee: Casio Computer Co., Ltd., Tokyo, Japan

[21] Appl. No.: 879,153

[22] Filed: Apr. 30, 1992

Related U.S. Application Data

[63] Continuation of Ser. No. 682,849, Apr. 4, 1991, abandoned, which is a continuation of Ser. No. 528,947, May 24, 1990, abandoned.

[30] Foreign Application Priority Data

| | | | |
|---|---|---|---|
| May 29, 1989 | [JP] | Japan | 1-62190 |
| May 29, 1989 | [JP] | Japan | 1-135084 |
| May 29, 1989 | [JP] | Japan | 1-135085 |
| May 29, 1989 | [JP] | Japan | 1-135094 |
| May 29, 1989 | [JP] | Japan | 1-135095 |
| May 29, 1989 | [JP] | Japan | 1-135096 |

[51] Int. Cl.[5] ..... G04B 19/26

[52] U.S. Cl. ..... 368/15; 368/223; 368/229

[58] Field of Search ..... 368/15-19, 368/10, 223-239

[56] References Cited

U.S. PATENT DOCUMENTS

| | | | |
|---|---|---|---|
| 4,253,169 | 2/1981 | Salah | 368/17 |
| 4,479,722 | 10/1984 | Salah | 368/17 |
| 4,548,512 | 10/1985 | Erard . | |
| 4,659,231 | 4/1987 | Barkouki | 368/15 |
| 4,681,459 | 7/1987 | Nabeyama et al. . | |
| 4,684,260 | 8/1987 | Jackle . | |
| 4,692,031 | 9/1987 | Kaneko et al. . | |

*Primary Examiner*—Bernard Roskoski

*Attorney, Agent, or Firm*—Frishauf, Holtz, Goodman & Woodward

[57] ABSTRACT

An astronomical data indicating device is provided with a memory for storing location data representing a location on the earth. In the present device, before calculation of astronomical data such as hour angle data of moon and moon phase data, at first hour angle data and moon phase data for Greenwich Mean Time are calculated regardless of the place where the present device is used, and then hour angle data and moon phase data at the place where the present device is used are calculated. Therefore, the calculation process is performed in a very simple manner.

19 Claims, 18 Drawing Sheets

| MOON PHASE (WAXING ⇌ WANING MOON) | NEW MOON | | WAXING MOON | | FULL MOON | | WANING MOON | | NEW MOON |
|---|---|---|---|---|---|---|---|---|---|
| ELONGATION(°) | 0 ~ 22.5 | 22.5 ~ 67.5 | 67.5 ~ 112.5 | 112.5 ~ 157.5 | 157.5 ~ 202.5 | 202.5 ~ 247.5 | 247.5 ~ 292.5 | 292.5 ~ 337.5 | 337.5 ~ 360 |
| MOON'S AGE (DAYS) | 0.0 ~ 1.8 | 1.9 ~ 5.5 | 5.6 ~ 9.2 | 9.3 ~ 12.9 | 13.0 ~ 16.6 | 16.7 ~ 20.2 | 20.3 ~ 23.9 | 24.0 ~ 27.6 | 27.7 ~ 29.5 |

FIG.11

ASTRONOMICAL DATA INDICATING DEVICE

This application is a continuation of application Ser. No. 07/682,849, filed Apr. 4, 1991, now abandoned, which is a continuation of application Ser. No. 07/528,947 filed May 24, 1990, now abandoned.

BACKGROUND OF THE INVENTION

The present invention relates to an astronomical data indicating device which is capable of performing operation to obtain astronomical data such as moon's age data, moon phase data and/or hour angle data of the moon and so on, and is also capable of obtaining and indicating a good time for hunting or fishing by performing operation of the above various data.

It is well known that movement of the moon affects an appetite of animals and fish. In fact, for example, many anglers have experience that they could successfully catch much fish on the day of a full moon or on the day of a new moon.

As described in U.S. Pat. Nos. 4,548,512, 4,684,260 and 4,692,031, as a device for indicating movement of the moon, a wrist watch is known, which has the hour and minute hands and is provided with a moon phase indicating disk or a moon's age indicating disk which makes one revolution during a period of about 29 days and half, thereby displaying figures of the moon.

In this type of analog watch having the moon's age indicating disk, not only its gear train becomes complex, but also it has a defect that precise moon phases can not be indicated. In particular, the actual revolution period of the moon, i.e. the period of the periodical change in figure of the moon varies in a range between about 29.2 days and about 29.8 days. This means that the above described moon's age indicating disk could not indicate such a precise moon phase. Even though a user of such analog watch should known that how many fish he can expect or an appetite of animals is greatly influenced by the movement of the moon, the user could not held deciding by himself depending on the moon phase, for example, how many fish can be expected, because the above moon's age indicating disk of the analog watch merely displays a moon phase.

SUMMARY OF THE INVENTION

The present invention has been made to improve the above mentioned inconvenience and has an object to provide an astronomical data indicating device which is capable of generating extremely precise astronomical data such as moon phase data, moon's age data and hour angle data of the moon.

Another object of the present invention is to provide an astronomical data indicating device which is capable of indicating a precise and good time for fishing or hunting by using data concerning the moon.

To achieve the above objects, according to the present invention there is provided an astronomical data indicating device, which comprises location data storing means for storing location data representing a first location on the earth;

first calculation means for performing calculation to obtain astronomical data representing astronomical position corresponding to a second location on the earth, said second location on the earth being previously decided on a place different from the first location represented by the location data;

second calculation means for performing calculation on the astronomical data obtained by said first operation means to obtain astronomical data corresponding to the first location represented by the location data stored in said location data storing means; and indicating means for indicating the astronomical data obtained by said second calculation means.

The device constructed as mentioned above may generate not only extremely precise astronomical data, but also the device, by using these precise data such as the data concerning the moon, may provide users of the device with appropriate reference information for fishing or hunting with simple manipulation.

BRIEF DESCRIPTION OF THE INVENTION

FIG. 11 is a view showing the relation among elongation of the moon, moon's age and moon phases;

DETAILED DESCRIPTION OF THE PREFERRED EMBODIMENTS

An embodiment of the present invention will be described hereafter which is applied to an electronic wrist watch.

Figure 1:
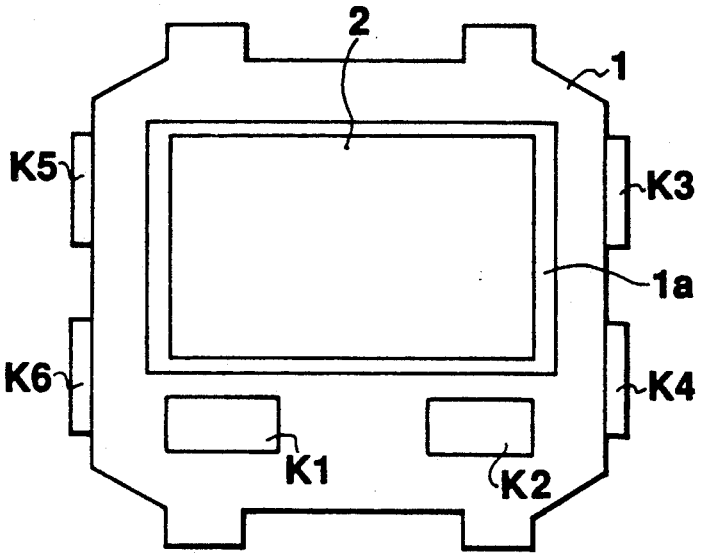
FIG. 1 is an external front view of an electronic wrist watch having a moon data indicating device which is one of embodiments of the present invention.

FIG. 1 is an external front view of the electronic wrist watch according to the present embodiment. In FIG. 1, the watch casing body 1 is provided with a watch glass 1a approximately at its front center portion and underneath the watch glass 1a there is provided a display section 2 comprising a liquid crystal display device.

Figure 2:
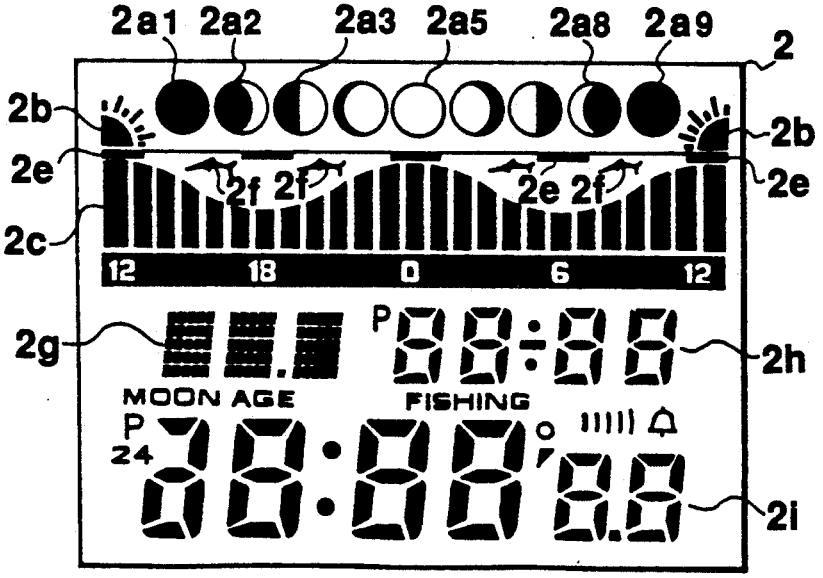
FIG. 2 is a view showing a display pattern on a display section of the electronic wrist watch of FIG. 1.

FIG. 2 is a view showing a construction of display elements (display electrodes) of the display section 2. There are provided nine units of moon phase display elements $2_{a1}$ to $2_{a9}$ at the upper portion of the display section 2. Nine units of the liquid crystal display elements from the display element $2_{a1}$ for a new moon at the left end side to the display element $2_{a9}$ for a new moon at the right end side are sequentially turned on for indication of the moon phase which changes as moon's age lapses in accordance with the moon waxing and waning motion.

At the side left to the left end display element $2_{a1}$, there is provided a sun display element 2b, which is turned on to indicate the sunrise, while a sunrise time is indicated on segment display elements 2h, as will be described later, while at the side right to the right end display element $2_{a9}$, there is also provided a sun display element 2b, which is turned on to indicate the sunset while a sunset time is indicated on segments 2i, which will be also described in detail later.

At the lower side to the above sun display elements 2b for indicating the sunrise and sunset and the moon phase display elements $2_{a1}$ to $2_{a9}$, there are provided 25 units of hour angle display elements 2c. One of the hour angle display elements 2c, which corresponds to an hour angle of the moon for each time obtained by hour angle operation, is turned on to indicate an hour angle of the moon, as will be described in detail later.

At the lower side to the hour angle display elements 2c, there are printed white colored numerals on a black background, which numerals indicate hour angles of the moon such as 0 hour, 6 hours, 12 hours and 18 hours. A user of the wrist watch can seen from these numerals which are turned on what time the hour angle display element 2c is indicating. At the upper portions to the numerals indicating 0, 6, 12 and 18 hours and the hour angle indicating elements corresponding to these numerals, indicating elements 2e of a bar type are printed for indicating good times for fishing or good times for hunting when the hour angles of the moon take these values 0, 6, 12, 18.

Four fish shaped indicating elements 2f printed on the upper side to the hour angle indicating elements 2c serve to indicate in accordance with the moon phase and the hour angle of the moon whether or not it is good time for fishing or hunting. The user of the wrist watch can get knowledge from the number of the fish shaped indication elements 2f which are turned on, if the good time for fishing or hunting is reached. For example, since the time is best for fishing when the moon is new moon and the hour angle of the moon is 0 hour or 12 hours, all of the fish shaped indication elements 2f are turned on to advise the user of the best time for fishing.

Dotted matrix indicating elements 2g appearing at the left intermediate portion of the display section 2 are capable of indicating three characters and serve to indicate other information such as day of the week and moon's age. Segment indicating elements 2h and 2i consisting of a plurality of digits serve to indicate date and time, respectively.

Referring to FIG. 1, the watch casing body 1 is provided with push button switches K1 and K2 at its lower portion to the display section 2. Push button switches K3 and K4 are provided on the right side wall of the casing body 1 and further push button switches K5 and K6 are provided on the left side wall. Operation of these push button switches will be described later.

Figure 3:
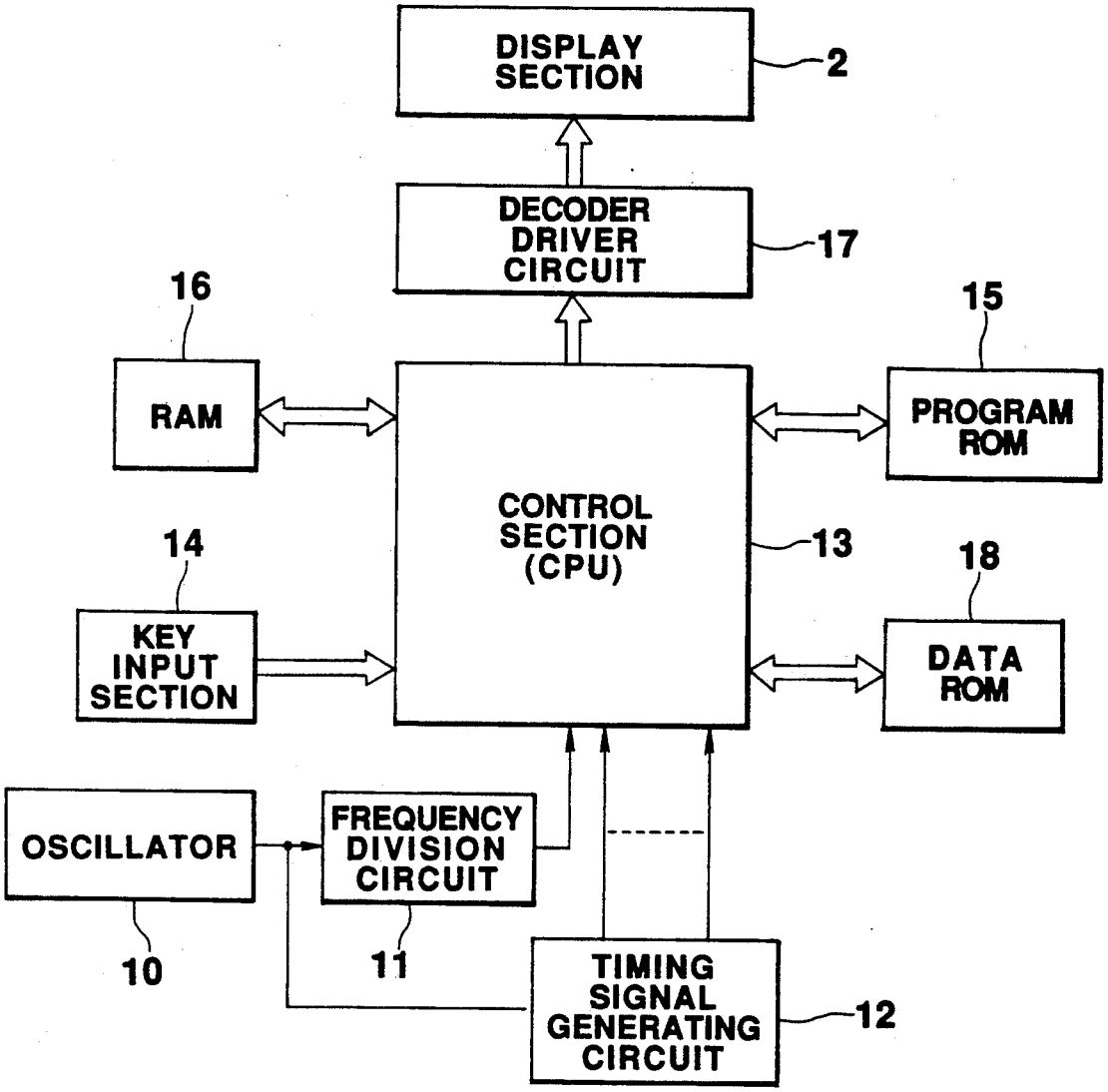
FIG. 3 is a circuit diagram of the electronic wrist watch of FIG. 1.

FIG. 3 is a view showing a circuit construction of the above mentioned electronic wrist watch. An oscillator 10 generates a clock signal having a constant frequency such as 32,768 HZ and supplies the same signal to a frequency division circuit 11 and a timing signal generating circuit 12. The frequency division circuit 11 divides the above clock signal to generate a time counting signal as a base reference signal for time counting operation of a control section (CPU) 13. The timing signal generating circuit 12 generates various timing signals for operations performed by various circuits (not shown) involved in the control section 13.

A key switch input section 14 comprises the above mentioned switches K1 to K6 and outputs key operation signals of these switches to the control section 13.

The control section 13 is a central processing unit, which performs operations to obtain the present time and hour angles of the moon under control of programs prepared for performance of operations in accordance with flow charts described later. The programs comprises a time counting program, a key program, a display program, an calculating program for calculating moon data such as hour angle and moon phase of the moon, a fishing program, all of which are stored in a program ROM 15. The control section 13 serves to store calculation data obtained by various calculations in RAM 16 as described later and supplies display data stored in RAM 16 to a decoder driver circuit 17. The display data fed to the decoder driver circuit 17 is converted into display signals and then is supplied to the display section 2 to be displayed as times, moon data such as moon phases and hour angles of the moon and so on.

Data ROM 18 is a read only memory for constants required for various calculations in the control sections 13.

Figure 4:
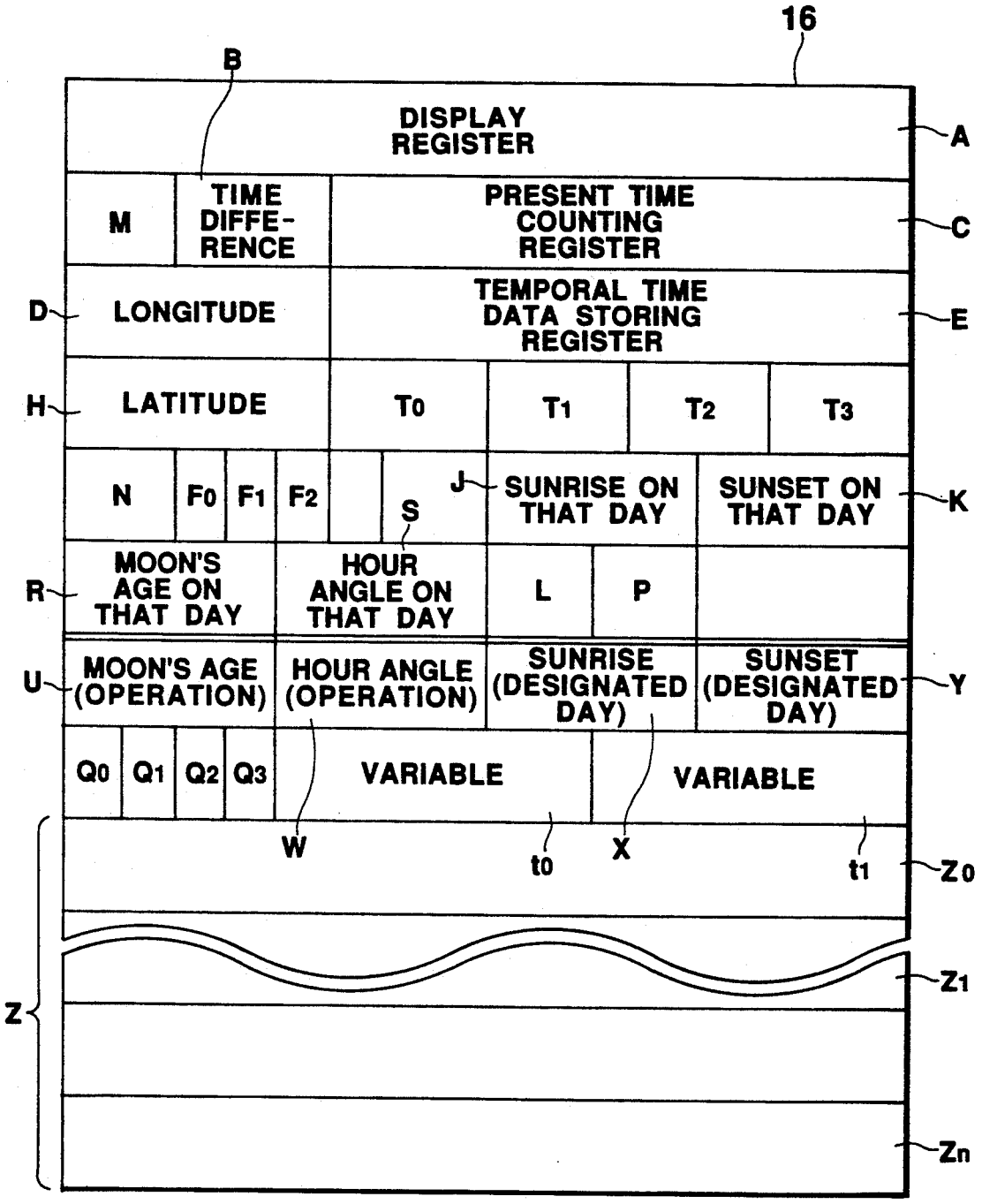
FIG. 4 is a view showing a register construction of RAM 16 shown in FIG. 3.

FIG. 4 is a view showing a construction of a register involved in RAM 16.

A register A in RAM 16 is a display register for storing display data, which is to be supplied to the above mentioned decoder driver circuit 17. A register M is a mode register, which is a register for storing numerical data corresponding to operation modes. The mode register M stores M=0 when the indicating device is in a present time display mode, stores M=1 when the device is in a fishing mode and stores M=2 when the device is in a sunrise and/or sunset time display mode. A present time register C serves to store present time data comprising time counted data such as year data, date data, day of the week data, hour data, minute data and second data.

A register B serves to store data of time difference between the time stored in the register C and Greenwich Time as a location data. A register D stores longitude data which is input as a location data and a register H stores latitude data which is also input as a location data.

A register E temporarily stores present time data stored in the register C. Registers T0 to T3 serves to store fishing time date obtained by an calculation described later.

A register N is used for selecting an operation form display operation for the present time (N="0"), modification operation for the present time (N="1"), modification operation for time difference, latitude and longitude (N="2") and display operation for the sunrise time and the sunset time (N="3"), when the wrist watch is in a present time display mode, i.e., when a register M takes a value "0".

A flag F0 is set (to F0="1") at time when a time carry of every one hour is generated while the register C is effecting time-counting of the present time. When this flag F0 is set, an hour angle calculation is performed as will be described later. In the same may, a flag F1 is set (to F1="1") by a day carry of every one day. When this flag F1 is set, a moon's age calculation is performed. A flag F2 is set to a value "1", when the wrist watch is in a fishing mode i.e., when the register M takes a value "1" to display a best time data for fishing, while the flag F2 is set to a value "1", when the wrist watch is in a sunrise and sunset time display mode, i.e., when the register M takes value "2" to display sunrise time or sunset time.

Registers J and K store a sunrise time data and a sunset time data. A register R stores moon's age data of the day obtained from an day carry of every one day stored in the register C, while a register S stores hour angle data obtained from hour carry of every one hour stored in the register C.

A register L stores numerical data which sequentially designate time difference, latitude and longitude which are to be sequentially modified, when the time difference, latitude and longitude are displayed or modified. A register P serves to sequentially designate and display times stored in the registers T0 to T3, when four times best for fishing in one day, which are stored in the registers T0 to T3, are selected and displayed.

A register U stores a moon's age data for the date set by switch input and a register W stores hour angle data of the moon for the time set by switch input. A register X stores sunrise time on the day set by switch input, while a register Y stores sunset time on the day set by switch input.

Registers Q0 to Q3 store data concerning how much fish is expected at the best times for fishing stored in the registers T0 to T3. In other words, the registers Q0 to Q3 store data for instructing how many fish-mark indicating elements 2*f* of FIG. 2 should be turned on.

Registers t0 and t1 store variables used in a time calculation for obtaining moon's age, hour angle of the moon, sunrise time and sunset times as will be described later. A register comprising registers Z0, Z1 through Zn is a work register for performing calculation or for temporarily storing operation results.

Figure 5:
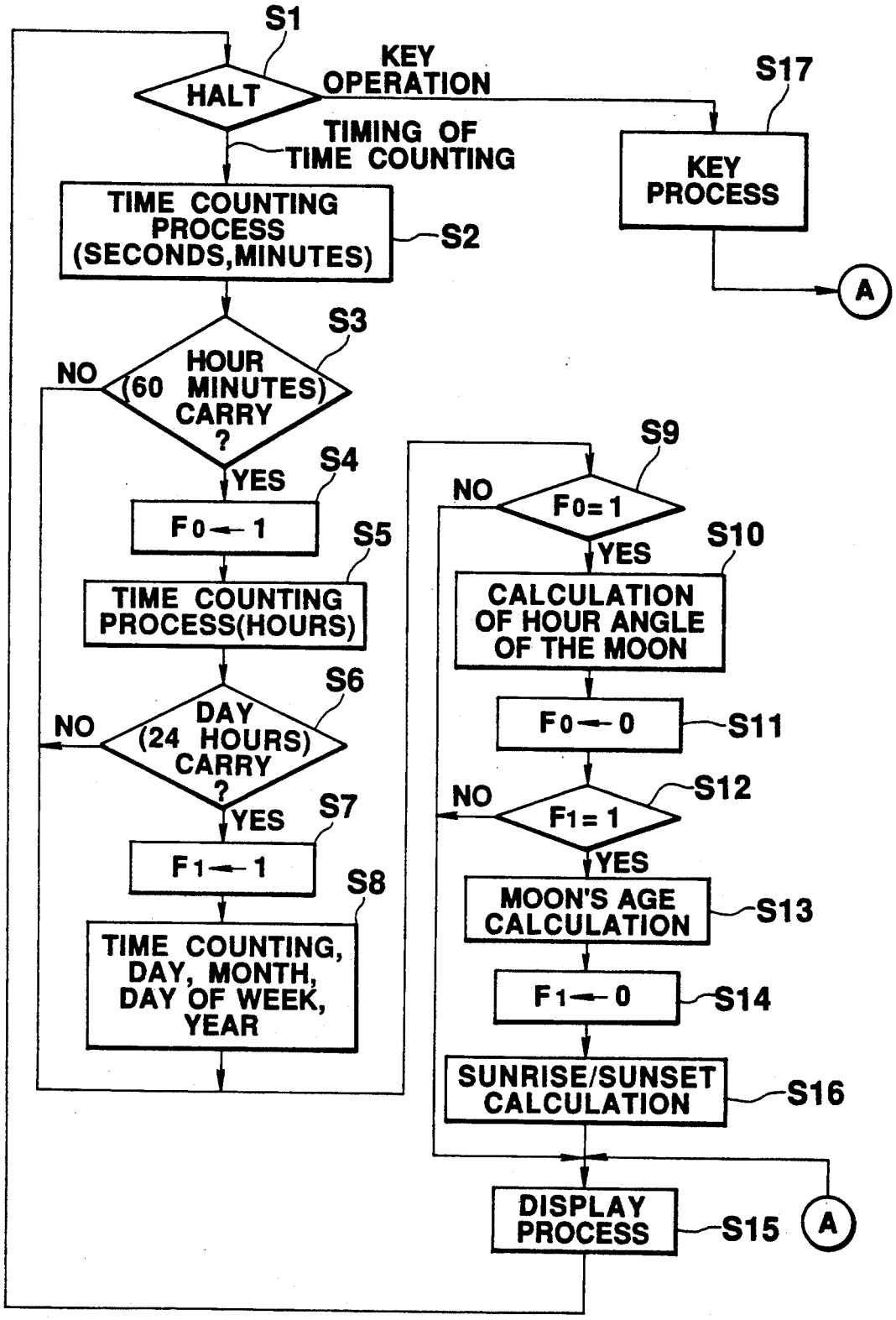
FIG. 5 is a flow chart of the whole operation of the above embodiment.

FIG. 5 is a whole flow chart illustrating operation of the circuit construction system of FIG. 3. The system at all times stays in a halt state at Step S1 of FIG. 5 and at time-count timing of, for example, every 16 Hz, the system executes a time-counting process in unit of less than hour unit. The system counts time in units of 1/16 seconds, second and minute in the time-counting process in unit of less than hour unit and outputs an hour carry signal, when data in minute unit reaches 60 minutes. At Step S3, the system judges if an hour carry signal has been generated. When the hour carry signal has been generated, a value "1" is set to a flag F0 at Step S4. Setting a value "1" to the flag F0 allows an hour angle operation to be performed in hour unit.

Thereafter, a time-counting process in hour unit is executed at Step S5. In the time-counting process in hour unit, it an hour carry signal has been generated as a result of the above mentioned time-counting process in unit of less than hour unit, data in hour unit is added with a value "1". When data in hour unit exceeds 24 hours, then a day carry signal is output.

At Step S6, the system judges if a day carry signal has been generated. When a day carry signal has been generated, a value "1" is set to a flag F1 at Step S7. Setting a value "1" allows a moon's age operation to be performed in day unit.

At step S8, a time-counting process is executed for day, month, day of the week and year. In this time-counting process, if a day carry signal has been generated, the day of the week is changed and data in day unit is added with a value "1". If a month carry signal or a year carry signal has been generated as a result of the above addition, time data in month unit or in year unit is revised and the revised time data is transferred to the time register C in RAM 16.

When the time counting process has been finished in a manner described above, the process advances to Step S9, where it is judges if a flag F0 is set. If F0=0 is true, i.e., if no hour carry signal has been generated, the process advances to a display process of Step S15 as will be described below. At Step S15, various data are displayed on the display section in accordance with values stored in the registers M and N.

In the meantime, if F0=1 is true at Step S9, it is judged that an operation timing has been reached for calculating hour angle of the moon of every hour, and at the following Step S10, an operation process is executed for calculating hour angles of the moon.

The operation for calculating hour angles of the moon at Step S10 will be described in detail later with reference to the flow chart of FIG. 6.

When the operation for calculating hour angles of the moon at Step S10 has been finished, the flag F0 is reset to "0" at Step S11 of FIG. 5. A next Step S12, it is judged if F1=0 is true.

When F1=0 is true, the process advances to a display process of Step S15 but when F1=1, i.e., when 24 hours have passed and date has been changed, the process goes to Step S13, where a moon's age calculation is executed.

The moon's age calculation at Step 13 will be described in detail later with reference to FIG. 10.

After execution of the moon's age calculation at Step S13, the flat F1 is reset to "0" at Step S14 and then at Step S16 a sunrise and sunset time operation is performed for calculating a sunrise time and sunset time on that day. At Step S15, a display operation is executed in accordance with a mood described later.

Figure 6:
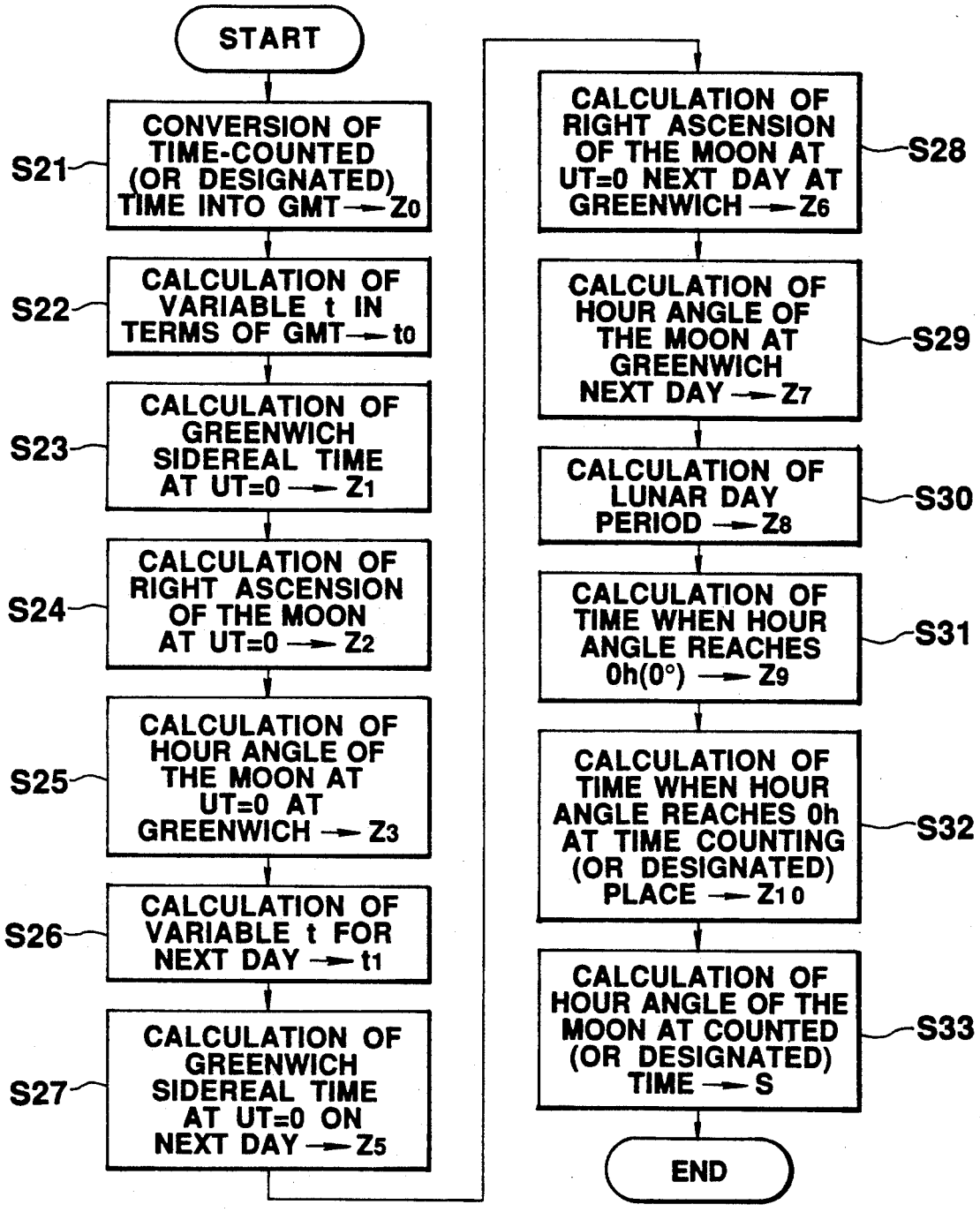
FIG. 6 is a flow chart showing a detailed operation process to obtain hour angle of the moon shown in FIG. 5.

FIG. 6 is a flow chart illustrating details of the hour angle operation at Step S10 of FIG. 5.

At Step S21 of FIG. 6, the present time counted in the time counting process and stored in the register C is converted into Greenwich means time on the basis of time difference data stored in the register B and the converted Greenwich mean time is stored in a register Z0 of RAM 16.

At Step S22, a variable t is calculated for obtaining Greenwich sidereal time and right ascension of the moon and is stored in the register t0 in RAM 16.

A variable t shall be obtained by dividing number of days which lapses from a predetermined day such as the noon of Jan. 1, 2000 (Greenwich Mean Time: GMT=Universal Time) by Eurus century (36,525 days). Let year be YE, month be MN, day be DA and hour be HO. Then, the variable t can be expressed by the following equation $$t=(Z\text{-}36556.5)/36525$$

where
W=(YE-1900)/4
F=FRAC(W)
A=INT(1461XW)
B=INT[(MN+7)/10]
C=INT(1−F)
D=INT [0.44X(MN+4.4)] and
Z=A+31 X MN+DA+(B−1) X C−B X D+HO/24

The variable t is calculated from the above equation and the result thereof is stored in a register t0 of RAM 16.

Then, at Step S23, Greenwich Sidereal Time is calculated at UT=0.

Greenwich Sidereal Time K can be expressed by the following equation;

$$K=24\ X\ FRAC(0.0027379\ X\ Y)$$

where
Y=Z−25012.

Greenwich Sidereal Time is calculated from the above equation and the result of the calculation is stored in a register Z1 of RAM 16.

The right ascension of the moon is calculated at UT=0 at Step S24.

The right ascension α(m) of the moon is given by the following equation;

$$\alpha(m)=24\times FRAC(\alpha/24)$$

where
α=32084.52539×T+14.55441+0.41925×COS(477198.868×T+44.963)+0.16358×COS(962535.762×T+166.633)+0.08494×COS(-413335.350×T+10.740)+0.07104×COS(1934.140×T+324.960)+0.07048×COS(964469.900×T-+41.590)+0.04389×COS(890534.220×T+145.700)

The right ascension α(m) of the moon is calculated at UT=0 from the above equation and the result of the calculation is stored in a register Z2 of RAM 16.

From Greenwich Sidereal Time and the right ascension of the moon, obtained as mentioned above, an hour angle of the moon at UT=0 at Greenwich is calculated at Step S25. The hour angle JK of the moon may be calculated from the following equation;

$$JK=K-\alpha(m):\ (K-\alpha(m)>0)$$

$$JK=K-\alpha(m)+24:\ (K-(m)<0)$$

where K is Greenwich Sidereal Time and α(m) is the right ascension of the moon.

The hour angle of the moon obtained from the above equation is stored in a register Z3 of RAM 16.

Since the hour angle of the moon at UT=0 on that day at Greenwich has been obtained as mentioned above, an operation is performed to calculate an hour angle of the moon on the following day.

At Step S26, date data of the time stored in the register Z0 is added with "1" and stored in the register Z4, and at the same time a variable t for the following day which is defined by adding "1" to the date data as described above is calculated and stored in the register t1 of RAM 16 in the same manner as in the process of Step S22.

A steps S27 and S28, Greenwich Sidereal Time and the right ascension of the moon at UT=0 on the following day are calculated, respectively and the results are stored in the registers Z5 and Z6 in the same manner as in the process of Steps S23 and S24.

At the following Step S29, an hour angle of the moon at UT=0 on the following day at Greenwich is calculated from the above Greenwich Sidereal Time and right ascension of the moon of the following day and the result is stored in the register Z7 of RAM 16.

Since the hour angle of the moon at UT=0 on that day at Greenwich as well as that at UT=0 on the following day at Greenwich have been calculated in the above operation, a lunar day period is calculated at Step S30.

The lunar day period is defined as a time duration from a time when an hour angle of the moon reaches 0h(0 hour) to a time when the hour angle of the moon reaches 0h(0 hour) for the second time. The lunar day period is a period the diurnal motion of the moon.

The lunar day period LNR can be expressed by the following equations:

$$LNR = 576/DJK\ (DJK > 0)$$

$$LNR = 576/(DJK + 24)\ (DJK < 0)$$

where DJK=(hour angle of the moon at UT=0 on the following day)−(hour angle of the moon at UT=0 on that day).

The lunar day period is calculated from the above equations and the result thereof is stored in a register Z8 of RAM 16.

Figure 7:
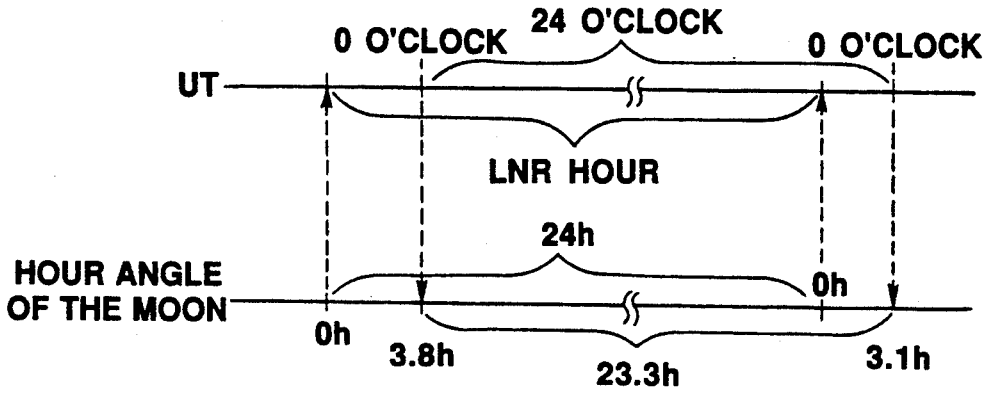
FIGS. 7 to 9 are views showing one example of operation for obtaining hour angle.

FIG. 7 is a chart illustrating, for easy understanding, an example of the calculation to obtain a lunar day period.

For example, we obtain $$DJK=3.1\ h-3.8\ h=-0.7\ h$$

where an hour angle of the moon at UT=0 at Greenwich is 3.8 h and an hour angle of the moon at UT=0 on the following day is 3.1 h.

Then, a lunar day period LNR is given by the following equation:

$$LNR=576/(-0.7+24)=24.7=24.7\ h$$

Referring to FIG. 6 again, a time (Universal Time) when an hour angle of the moon reaches 0h is calculated at Step S31.

The time when the hour angle of the moon reaches 0h can be expressed by the following equation:

UT=(hour angle of the moon at UT=0 on that day)

×(lunar day period/24)

The time when an hour angle of the mon reaches 0h at Greenwich is calculated from the above equation and the result is stored in a register Z9 of RAM 16.

Figure 8:
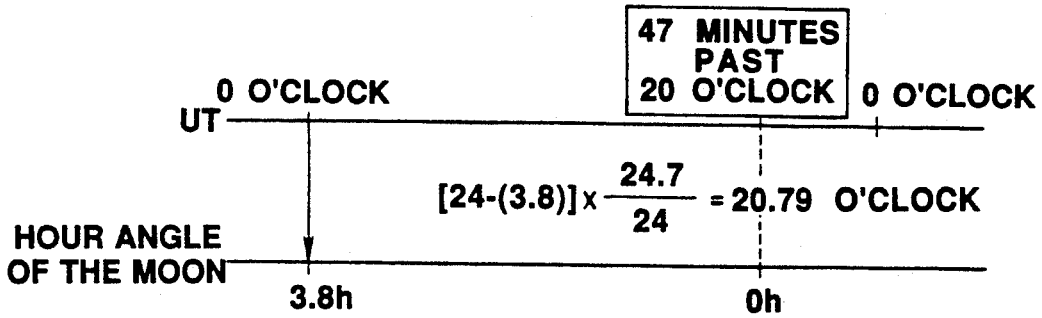

FIG. 8 is a chart illustrating, for easy understanding, calculation for obtaining a time (Universal Time) when an hour angle of the moon reaches 0h.

For example, let an hour angle of the moon at UT=0 be 3.8 h Then, the time when an hour angle of the moon is equal to 0h may be obtained from the lunar day period, 24.7 h given in FIG. 7 as follows:

$$(24-3.8)\times(24.7/24)=20.79 \text{ (47 minutes past 20 o'clock)}$$

At Step S32 in FIG. 6 a time when an hour angle of the moon reaches 0h at a designated location or at a location where time counting is executed is calculated from the time, calculated in the above operation, when the hour angle of the moon reaches 0h at Greenwich. A time TH when the hour angle of the moon reaches 0h at a given location may be calculated from the following equation:

$$TH=(\text{time at hour angle}=0h \text{ at Greenwich})+(\text{time difference from Universal Time})-(\text{lunar day period}/24)+(\text{longitude}/15)$$

The time TH when the hour angle of the moon reaches 0h at the time counting location is calculated by substituting the longitude of the time counting location and the time difference from Greenwich Mean Time in the above equation and the result is stored in a register Z10 of RAM 16.

For example, the time TH when the hour angle of the moon reaches 0h at Tokyo locating at 139.75 degrees of the east longitude is given by the following equation:

$$TH=20.79 \text{ hours}+9 \text{ hours}-(24.7 \text{ hours}/24 \text{ h})\times(239.75/15)-20.20 \text{ hours}=12 \text{ minutes past 20 o'clock}$$

where time difference between Tokyo and Greenwich is +9 hours, the lunar day period obtained as shown in FIGS. 7 and 8 is 24.7 hours and Universal Time at hour angles−0 is 20.79 hours.

After the time when the hour angle of the moon reaches 0h at a given location is obtained in the above operation, a present time under time counting operation at Step S33, i.e., an hour angle of the moon at the time stored in the register C is calculated and stored in a register S of RAM 16.

Figure 9:
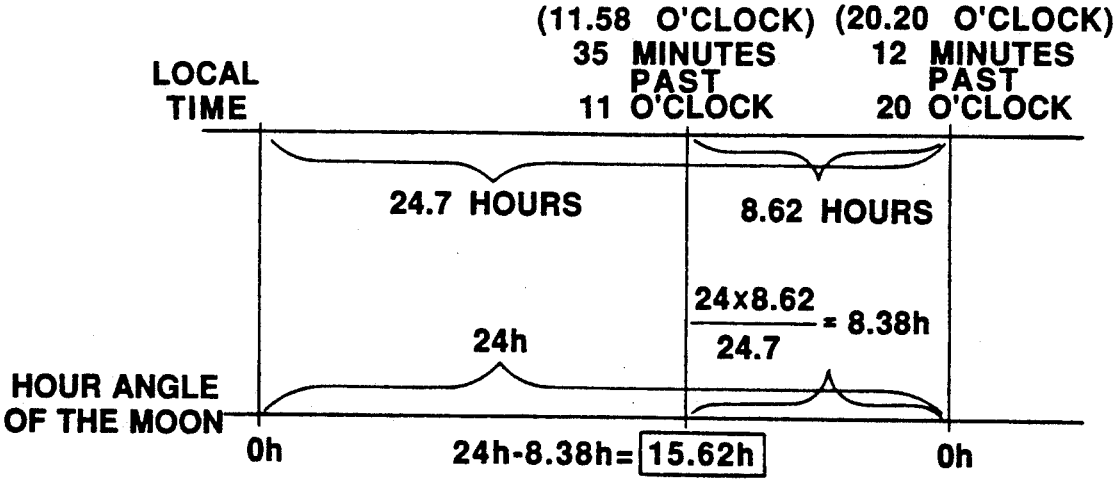

FIG. 9 is a chart illustrating an example of calculation to obtain hour angle of the moon: 35 minutes past 11 o'clock, at Tokyo.

A hour angle difference of the moon is obtained by a proportion calculation using the lunar day period=24.7 hours, the time=12 minutes after 20 o'clock when the hour angle of the moon reaches 0h at Tokyo and a time difference from the present time to be obtained, 35 minutes after 11 o'clock. We obtain, Hour angle difference$=24\times8.62/24.7=8.38$ h By subtracting the hour angle difference: 8.38 h from 0h(=24 h), the hour angle 15.62 h of the moon at 35 minutes after 11 o'clock can be obtained.

In other words, a precise hour angle of the moon at a given time at a given location can be easily obtained by the above operation using the longitude of the given location and a time difference from Greenwich Mean Time.

Figure 10:
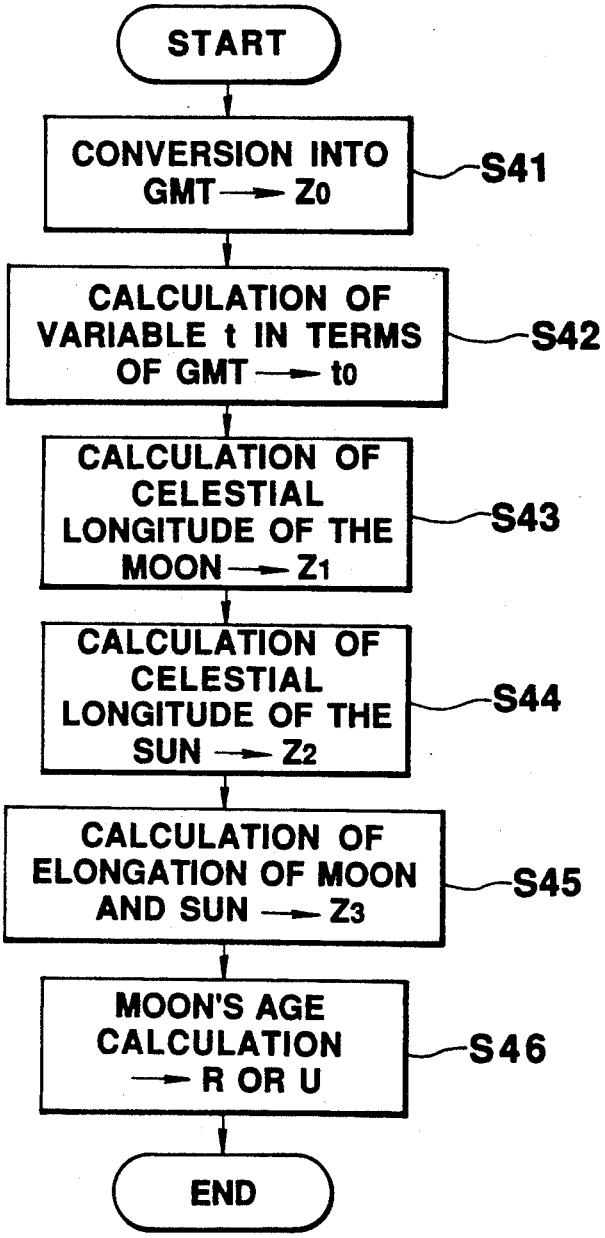
FIG. 10 is a flow chart showing operation of in FIG. 5 for obtaining moon's age.

FIG. 10 is a flow chart illustrating details of a moon's age calculation at Step S13 of FIG. 5. At Step S41, the time stored in the present time register C is converted into Greenwich Mean Time on the basis of the time difference from Greenwich Mean Time stored in the register B. Then, the above described variable t is calculated from the Greenwich Mean Time at Step S42.

Now, at Step S43 the celestial longitude of the moon is calculated from the following equation using the variable t obtained at Step S42:

$$\text{Celestial longitude of the moon}=481267.9\times t+218.3+6.3\times\cos(45+4572000\times t)+1.3\times\cos(11+413300\times t)$$

In the same way, at Step S44 the celestial longitude of the sun is calculated from the following equation:

$$\text{Celestial longitude of the sun}=36000.8\times t+280.5+1.9\times\cos(268+360000\times t)$$

At Step S45 an elongation of the moon is obtained from a difference between the celestial longitude of the moon and the celestial longitude of the sun obtained as mentioned above.

Elongation of the moon means an angle between an imaginary straight line from the earth to the sun and another imaginary straight line from the earth to the moon. The moon phase changes with variations of the elongation of the moon. For example, when the elongation of the moon is 0 degree, the moon is a new moon. When the elongation of the moon is 180 degrees, the moon is a full moon and when the elongation of the moon is 270 degrees, the moon is a waning moon.

At step S46, moon's age data is calculated from the above elongation of the moon and the waxing and waning period of the moon and the result is stored in a register R.

In the present embodiment, assuming that an average waxing and waning period of the moon is 29.53 days, moon's age at Greenwich Mean Time is calculated from a proportion-calculation using the above waxing and waning period of the moon and the elongation of the moon calculated every day. Then, the moon's age at the corresponding location is calculated using a time difference between Greenwich Mean Time and the local time at the location. The moon's age at a given location may be expressed by the following equation:

$$\text{Moon's age}=29.53\times(\text{elongation}/360)-(\text{time difference}/24)-0.5$$

FIG. 11 is a table which lists relations among elongation of the moon, moon's ages and phases of the moon.

Figure 12:
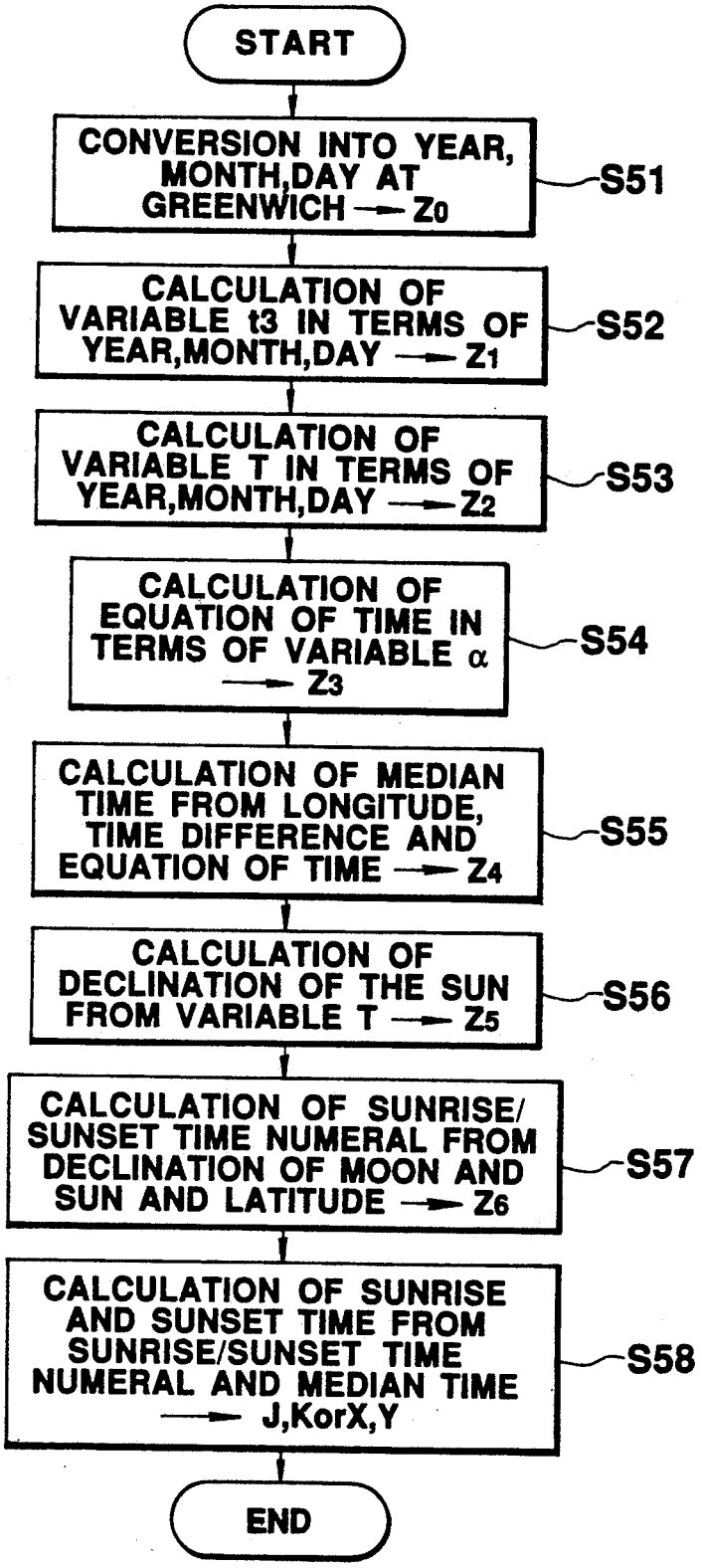
FIG. 12 is a flow chart showing operation of FIG. 5 to obtain sunrise and sunset times.

If a difference (elongation of the moon) between the celestial longitude of the moon and the celestial longitude of the sun, both of which are calculated in the above operation, is in the range, for example of 0 to 22.5 degrees, the moon's age takes a value in the range of 0.0 to 1.8 days in accordance with the elongation of the moon. The calculated moon's age data is written into the register R of RAM 16. The moon's age of 0.1 to 1.8 days corresponds to a new moon. In the similar manner, if the moon's age is in the range of 157.5 to 202.5 degrees, moon's age data taken a value in the range of 13.0 to 16.6 days. The moon's age data obtained thus is written into the register R. The moon's age of 13.0 to 16.6 days corresponds to a full moon. When the elongation of the moon is in the other angle range, the relation among the elongation, moon's age and phase of the moon are also illustrated in the table of FIG. 11. FIG. 12 is a flow chart illustrating in detail a sunrise and sunset time calculation at Step S16 in FIG. 5.

In the process at Step S51, the present time is converted into Greenwich Mean Time and the result is stored in the register Z in the similar manner to that at Step S41 of FIG. 10.

At Step S52, a valiable t3 of number of days lapsed from January 1 of the year is obtained.

Let year be YE, month be MN and day be DA. Then, we obtain $$Y=A+31\times MN+DA+(B-1)\ X\ C-B\ X\ D$$

where

W=(YE−1900)/4
F=FRAC(W)
A=INT(1461×W)
B=INT[(MN+7)/10]
C=INT(1−F)
D=INT[0.44×(MN+4.4)].

Further, we obtain $$YY=A+31+(B-1)\ X\ C-B\ X\ D$$

where

W=(YE−1900)/4
F=FRAC(W)
A=INT(1461×W)
B=INT[(MN+7)/10]
C=INT(1−F)
D=INT[0.44×(MIN+4.4)].

Then, the variable t3 may be obtained from the following equation:

$$t3=Y-YY$$

The variable t3 is stored in the register z0.

Similarly to Step S42, the valiable t is obtained at Step S53. A mean time difference KJS is obtained from the valiable t3 and the result is stored at Step S54. The mean time difference KJS can be calculated from the following equation:

$$KJS=C+D \text{ (seconds)}$$

where

A=(t3−80.5)×360/360.25
B=(t3−4.5)×360/360.25
C=−460.64×SIN(B)−4.82×SIN (2×B)
D=592,32×SUB (2×A)−12.76×SIN (4×A)

At Step S55 a median time is obtained from the following equation:

Median time=12−longitude/15 degrees+GMT time difference—mean time difference/3600 where data int he register D is used for the above longitude, data int he register B is used for GMT time difference and data obtained at Step S54 is used for the mean time difference.

At Step S56, declination of the sun is calculated from the following equation:

$$\begin{aligned}\text{Declination} = {} & 23.26\times\text{COS}(36001\times T+190)+\\ & 0.39\times\text{COS}(2\times t+13)+\\ & 0.39\times\text{COS}(72000\times t+188)+\\ & 0.16\times\text{COS}(108002\times t+211)+\\ & 0.01\times\text{COS}(72003\times t+34)+\\ & 0.01\times\text{COS}(144001\ t+209)\end{aligned}$$

where t is a variable.

At Step S57, sunrise and sunset time numeral is calculated. The sunrise and sunset time numeral (hereafter referred to as SSTN) is expressed as follows:

$$A=TAN\ (0)\times TAN\ (1)$$

$$B=-0.017/COS\ (0)\times COS\ (1)$$

$$SSTN=[arcCOS(B-A)]/15 \text{ degrees}$$

where latitude is 0 and declination is 1.

At the last Step S58, sunrise and sunset times are calculated and the results are stored in registers J and K of RAM 16, respectively. The sunrise time and sunset time are calculated from the following equations:

Sunrise time=median time−SSTN sunset time=median time+SSTN

Figure 13:
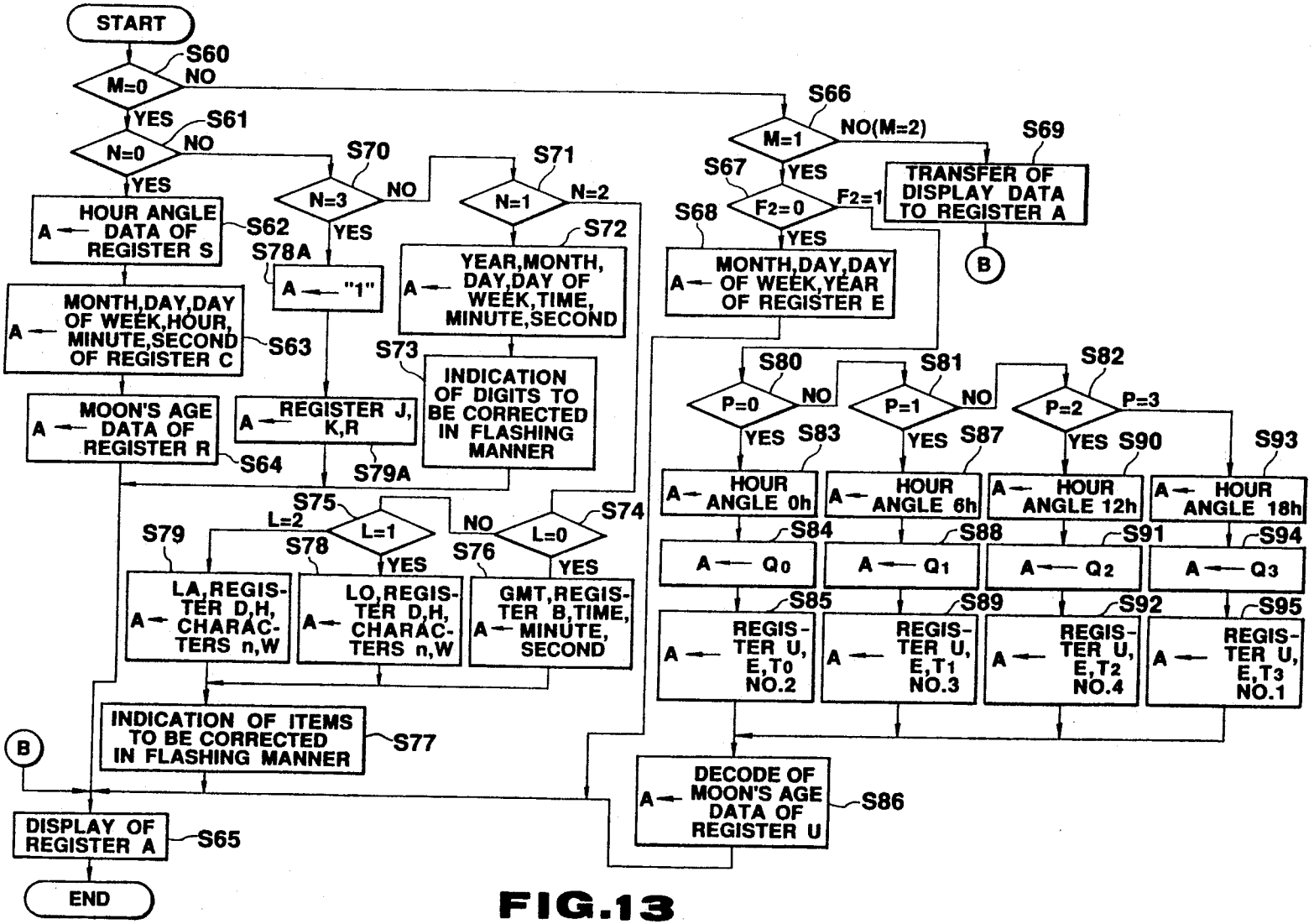
FIG. 13 is a flow chart showing display processes of FIG. 5.
Figure 14:
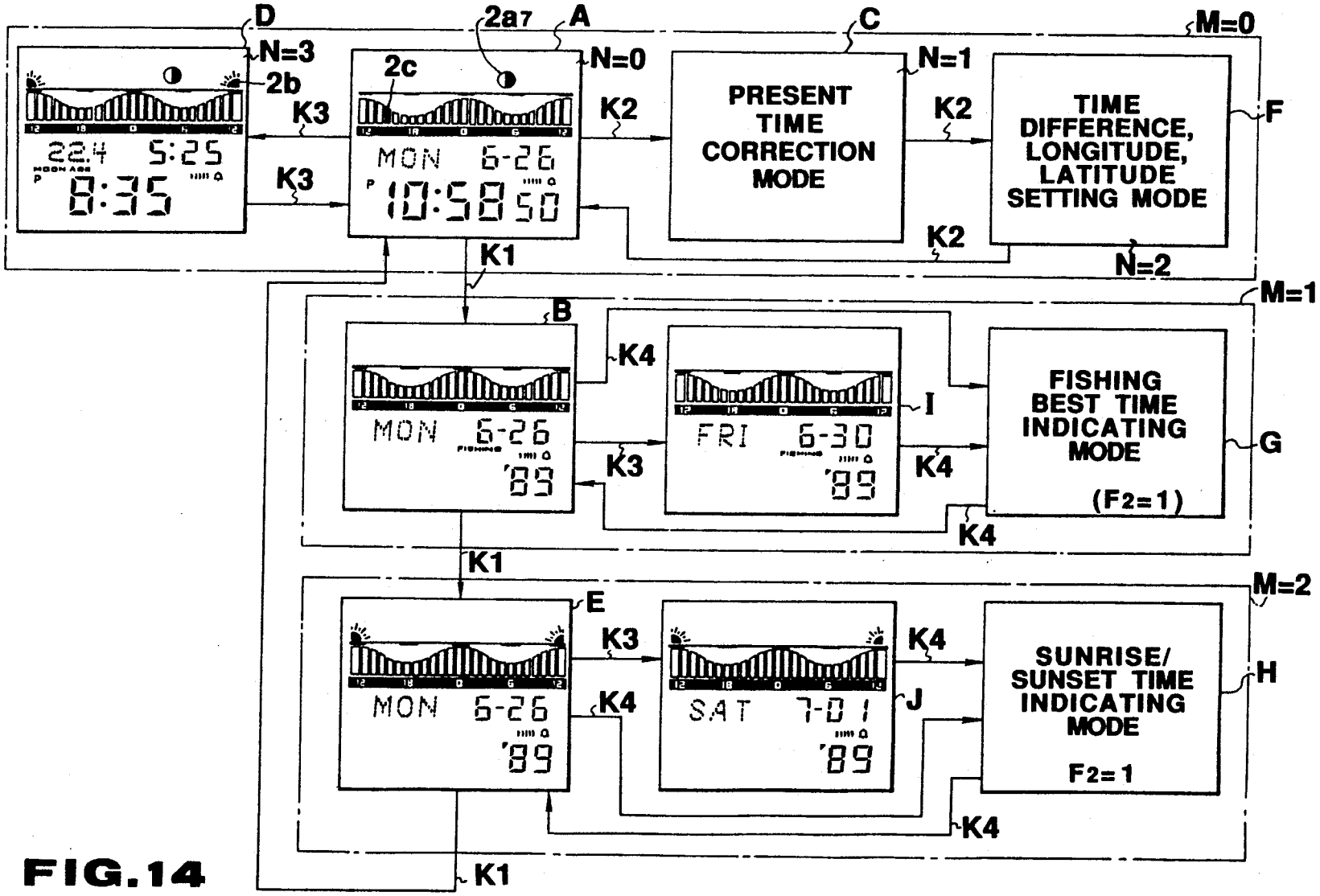
FIG. 14 is a view showing transition of displays in respective operation modes.

FIG. 13 is a flow chart illustrating in detail the display process at Step S15 of FIG. 5, and FIG. 14 illustrates transition of display states on the display section 2.

At Step S60 of FIG. 13, it is judged if a value of the mode register M is "0". When M="0", the process advances to Step S61, where it is judged if a value of the register N is "0". When N="0", hour angle data, present time data and moon's age data of respective months are transferred to the display register A of RAM 16 at Steps 62, 63 and 64, respectively. At Step 65, the data stored in the register A are transfered to the recoder driver circuit 17 of FIG. 3 and are displayed on the display section 2. Accordingly, when in the present time display mode, i.e., the register M="0", and the register N="0", the present time, 58 minutes 50 seconds after 10 o'clock P.M., June 26, monday is displayed on the display section 2 and the moon phase on the day is displayed by a display element $2_{a7}$, as shown at A in FIG. 14, whereby a user of the wrist watch can get knowledge that the moon is a waning moon and that the hour angle is 15*h*, i.e., the moon is in the direction of 15*h* by a turned-on display element 2*c*.

Figure 15:
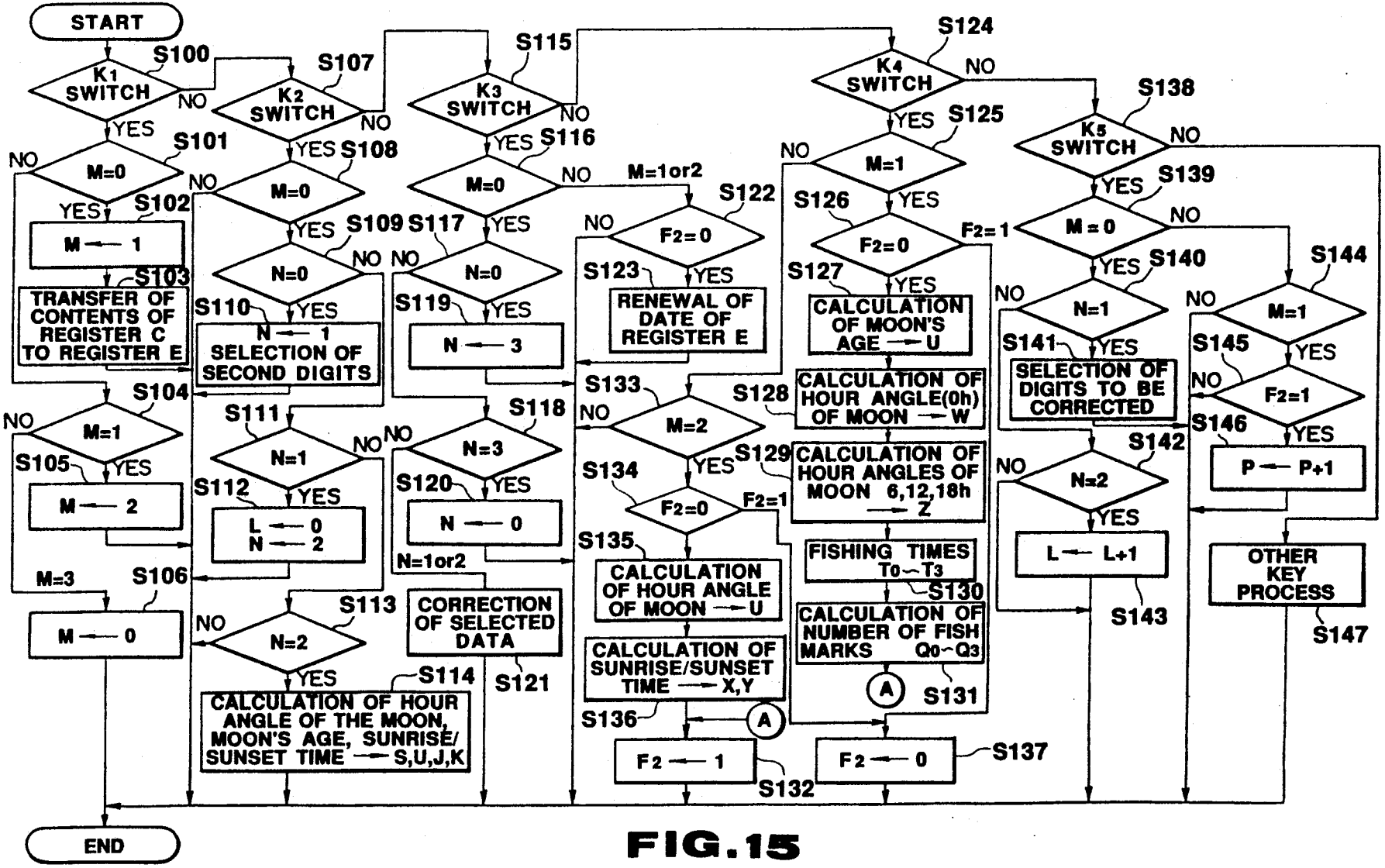
FIG. 15 is a flow chart showing detailed key processes.

When switches K1, K2 and K3 are operated, respectively in the display stage at A in FIG. 14, display on the display section is changed as shown at B, C and D in FIG. 14. More specifically, when any one of switches K1 through K6 is operated at Step S1 of FIG. 5, it is judged that a key signal has been input, and a key process is executed at Step S17. FIG. 15 illustrates details of the key process of Step 17. At Step S100, it is judged if the key K1 is operated. When the result is "YES", the process advances to Step S101, where it is judged if the register M is "0". When the register M is "0", the process advances to Step S102, where "1" is set to the register "M". At Step S103, the present time stored int he register C is transferred to the register E and is stored therein. When it is judged at Step S101 that M="0" is not true, the process goes to Step S104, where it is judged if M="1" is true. When M="1" is true, "2" is set to the register M at Step 105. When M="1" is not true, it is judged that M="2" is true and the process advanced to Step S106, where "0" is set to the register M. In other words, the register M sequentially takes one of values "0", "1", "2", "1" and so on every time the key switch K1 is operated. In the display process of FIG. 13, when M="1", the process advances from Step S60 to Step S66, where it is judged if M="1" is true. When the result is "YES", then the process advances to Step S67, where it is judged if the flag F2 is "0". When the flag F2="0" is true, contents of the register E are transferred to the register A. More specifically, month data, date data, day of the week data and year data involved in the present time data which have been transferred to the register E at Step S103 of FIG. 15, when the switch K1 is operated at M="0", are transferred to the register A and are displayed at the following Step S65. Hence, when M="1", the display on the display section is shown at B in FIG. 14. When it is judged at Step 66 of FIG. 13 that M="1" is not true, i.e., when M="2" is true, the process advances to Step S69, where data to be displayed is transferred to the register depending on that the flag F2 is "1" or "0" (not shown), and the data is displayed at Step S65. For example, when F2="0", the present date shown at E or updated date as shown at J is displayed, and when F2 is "1", sunrise and sunset times are displayed as described later.

In FIG. 15, when the switch K2 is operated, the operation of the switch K2 is detected at Step S107 and it is judged if M="0" is true at the following Step S108.

When M="0", it is judged that the switch K2 has been operated in the present time display mode and then a value of the register N is discriminated respectively at Step S109, S111 and S113. When a value of the register N is "0", it is judged that the switch K2 has been operated in a state of A of FIG. 14 and the process advances to Step S110, where a value "1" is set to the register N and digits for representing "second" are designated to be corrected. When a value of the register N is "1", the process advances from Step S111 to Step S112, where a value "0" is set to the register L while a value "2" is set to the register N. When a value of the register N is "2", the process advances from Step S113 to Step S114, where operations for obtaining hour angle of the moon, moon's age and sunrise and sunset times are executed in the same manner as in the process of Steps S10, S13 and S16 in FIG. 5 and at the same time a value "0" is set to the register N.

Figure 16:
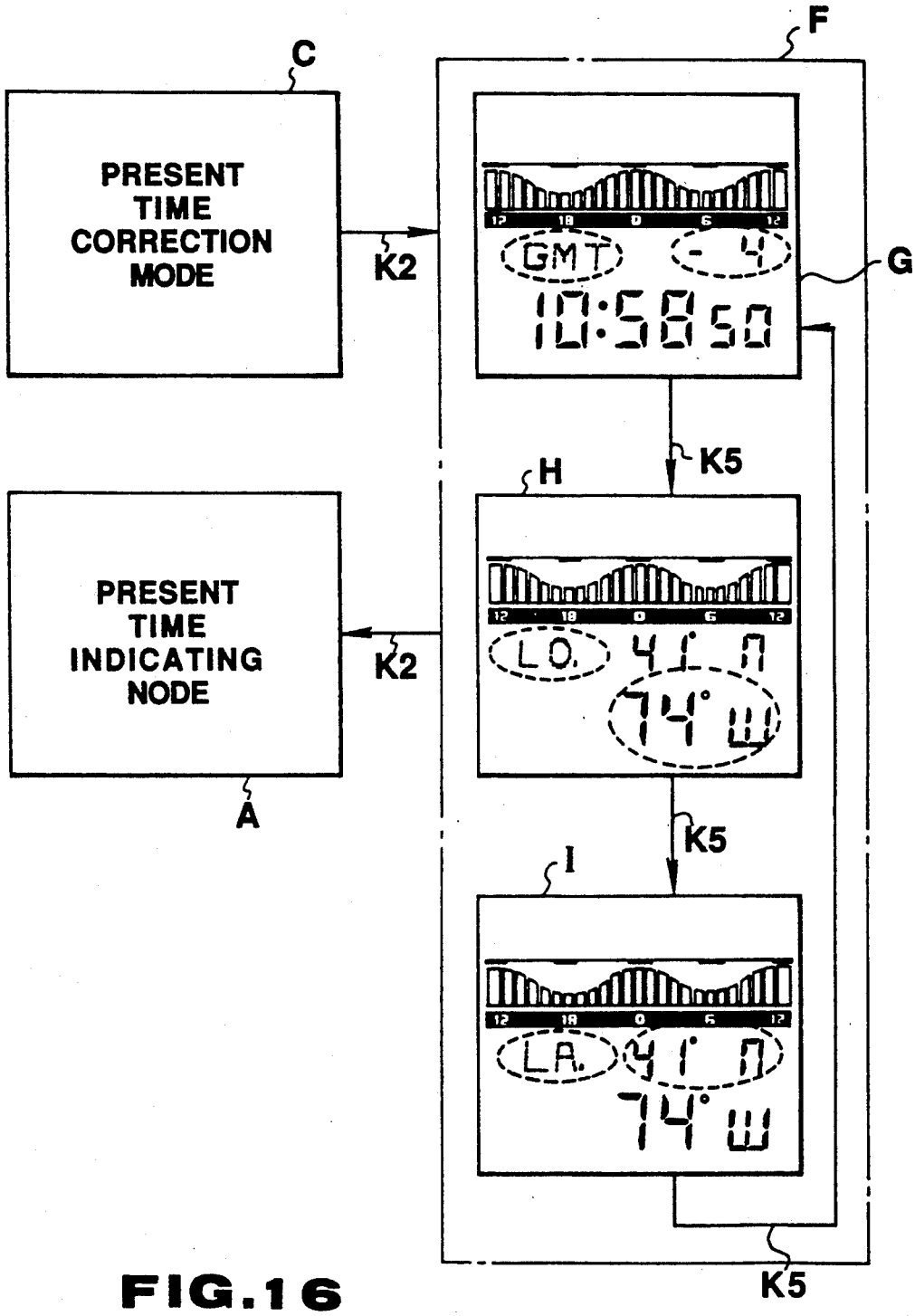
FIG. 16 is a view showing display states in a time difference setting mode, a longitude setting mode and a latitude setting mode.

As described above, when the switch K2 is operated at M="0" and a value of the register N is changed from "0" to "1" or from "0" to "2", display on the display section is switched as follows. In the display process of FIG. 13, when M="0", the processd advances from Step S60 to S61 and it is judged at Step S71 if a value of the register N is "3". At Step S71, it is judged if a value of the register N is "1". When N="1", the process advances to Step S72, where the present time data in the register C is transferred to the display register A. At Step S73, digits to be corrected are subject to a flashing process. Accordingly, when N="1", the wrist watch is brought to a time correction mode, where the present time may be corrected as shown at C in FIG. 14. When the switch K2 is operated at N="1" and the value of the register N is changed to "2" at Step S112, the wrist watch is brought to a time difference/longitude/latitude setting mode. The process in the display process of FIG. 13 advances from Step S71 to Steps S74 and S75, where a value of the register L is discriminated. When a value of the register L is "0", the process advances from Step S74 to Step S76, where character data of GMT, time difference data of the register B and time/minute/second data of the register C are transferred to the register A. At Step S77, digits to be corrected, for example character data of MGT and time difference data at L="1", are subject to the flashing process. Accordingly, the display on the display section is as shown at G in FIG. 16. A value of othe register L is changed by operation of the switch K5. When L="1", LO characters representing longitude, longitude data of the register D, latitude data of the register H and n-character data and w-character data are transferred to the register A at Step S78, and LO character and longitude data which are to be corrected are subject to the flashing process. When L="2", LA characters, data of the registers D and H, character data n and w are transferred to the register A at Step S79 and the process advances to the following Step S77. When a value of the register L is "1" or "2" at N="2", display on the display section is as shown at H and I in FIG. 16. Data which are turned on in a flashing fashion on the display shown at G, H and I are corrected by operation of the switch K3 as described later. When the switch K2 is operated at N="2", the wrist watch returns to the present time display mode at N="0" shown at A in FIGS. 14 and 16. More specifically, in the present time display mode, hour angle of the moon, moon's age, sunrise time and sunset time are calculated on the basis of the present time, time difference, longitude data and latitude data, all of which have been corrected. Therefore, the hour angle of the moon and the moon phase obtained on the basis of the corrected data are displayed in the present time display mode at N="0".

An operation of the switch K3 is detected at Step S115 in FIG. 15 and the process advances to Step S116, where it is judged if M="0" is true. When M="0", or when the present time display mode is set, it is judged at Step S117 if N="0" is true and it is also judged at Step S118 if N="3" is true. When N="0" is true, a value "3" is set to the register N at Step S119. When N="3" is true, a value "0" is set to the register N at Step S120. When N="3", it is judged that N="3" is true at Step S70 in the display process of FIG. 13 and data for displaying the sunrise mark indicating element 2*b* and the sunset mark indicating element 2*d* of FIG. 2 is set to the register A at Step S78A, and the sunrise time, sunset time and the moon's age data of the day which have been stored in the registers J, K and R, respectively are transferred to the register A at Step S79A.

When the switch K3 is operated in the display state at M="0" and N="0" as shown at A in FIG. 14, a value "3" is set to the register N at Step S119 of FIG. 15. When N="3", an operation is executed at Steps S78 and S79 in FIG. 13 for displaying the sunrise mark indicating element 2*b*, sunset mark indicating element 2*b* sunrise time, sunset time and moon's age data. Therefore, as shown at D in FIG. 14, the sunrise time of the day, 25 minutes after 5 o'clock and the sunset time, 35 minutes after 8 o'clock are indicated on the display section together with the sunrise and sunset mark indicating elements 2*b* and 2*b*, and the moon's age data are 22.4 days and the moon phase are indicated, too. When the switch K3 is operated in the display state shown at D of FIG. 14, a value "0" is set to the register N at step S120 in FIG. 15 and the wrist watch returns to the present time display mode shown at A in FIG. 14.

When it is judged at Step S118 in FIG. 15 that N="3" is not true, it is judged that the register N has been set to "1" or "2", and more specifically, it is judged that the present time correction mode shown at C in FIG. 14 or the time difference/longitude/latitude setting mode shown at F in FIG. 14 has been set. At Step S121, when the present time correction mode is set, digits to be corrected are corrected, and when the time difference/longitude/latitude setting mode is set, time difference data, longitude data and latitude data designated by the register L are sequentially corrected or set.

When it is judged at Step S116 in FIG. 15 that M="0" is not true, it is judged that the register M has been set to "1" or "2" and the process advances to Step S122, where it is judged if F2="0" is true. When F2="0" is true, a process is executed to increment the date involved in the present time data of the register C, which data is transferred to the register E at Step S123. More specifically, when the wrist watch is set to the mode of M="1", a best time for catching fish on the present date transferred to the register E or on the desired date obtained by correcting the above date is displayed in a best time for fishing display mode (F2="1"). When the wrist warch is set to the sunrise/sunset time display mode of M="2", a sunrise time and sunset time on the present date or on the set desired-date are displayed. At Step S123 in FIG. 15, date of the register E is renewed to obtain a desired date. At I in FIG. 14 is shown an example that date data, Jun. 26, 1989 involved in the present time data stored in the register E shown at B in FIG. 14 is advanced to Jun. 30, 1989 by operation of the switch K3. Another example is shown at J in FIG. 14 that the date is advanced from Jun. 26, 1989 to Jul. 1, 1989. These display processes are executed at Step S68 of FIG. 13 when M="2" and at Step S69 when M="2". A process for calculating a best time for fishing, sunrise time and sunset time is executed on the basis of date data stored in the register E by operation of the switch K4, which process will be described in detail hereafter.

An operation of the switch K4 is detected at Step S124 of FIG. 15 and it is judged if M="1" is true. When M="1", it is judged at Step S126 if F2="0" is true, i.e., if the display state of B or I of FIG. 14 is set. When F2="0", the process advances to Steps S127 and S128, where the operation for obtaining moon's age and the operation for obtaining hour angle of the moon are performed, respectively. The operation for obtaining the moon's age at Step S127 is almost similar to the operation of Step S13 in FIG. 5, i.e., the operation shown in FIG. 10. The operation in FIG. 10 is performed to obtain the moon's age based on the present time of the register C but the operation at Step S127 is different from the operation shown in FIG. 10 merely in that the operation at Step S127 is performed on the basis of time data stored in the register E, i.e., on the basis of the present time data or time data arbitrarily set by operation of the switch K3 and in that moon's age data obtained by the operation at Step S46 of FIG. 10 is stored not int he register R but in the register U. The operation at Step S128 for obtaining hour angle of the moon is performed in a similar manner to the operation performed at Steps S21 through S32 but is different in that the operation at Step S128 is performed on the basis of the time data in the register E. At Step S32, a time when the hour angle reaches 0h (hour) is obtained and stored in a register W. In the same manner, times when hour angle reaches 6h, 12h and 18h are calculated at Step S129. The time data obtained at Steps S128 and S129 are stored in the registers T0 through T3, respectively. At Step S131, fish catch forecasting data is calculated for the moon's age data obtained at Step S127 and hour angle data of 0, 6, 12 and 18 hours and the calculated fish catch forecasting data corresponding to hour angles of 0, 6, 12 and 18 hours are stored in registers Q0 through Q3, respectively.

Figure 17:
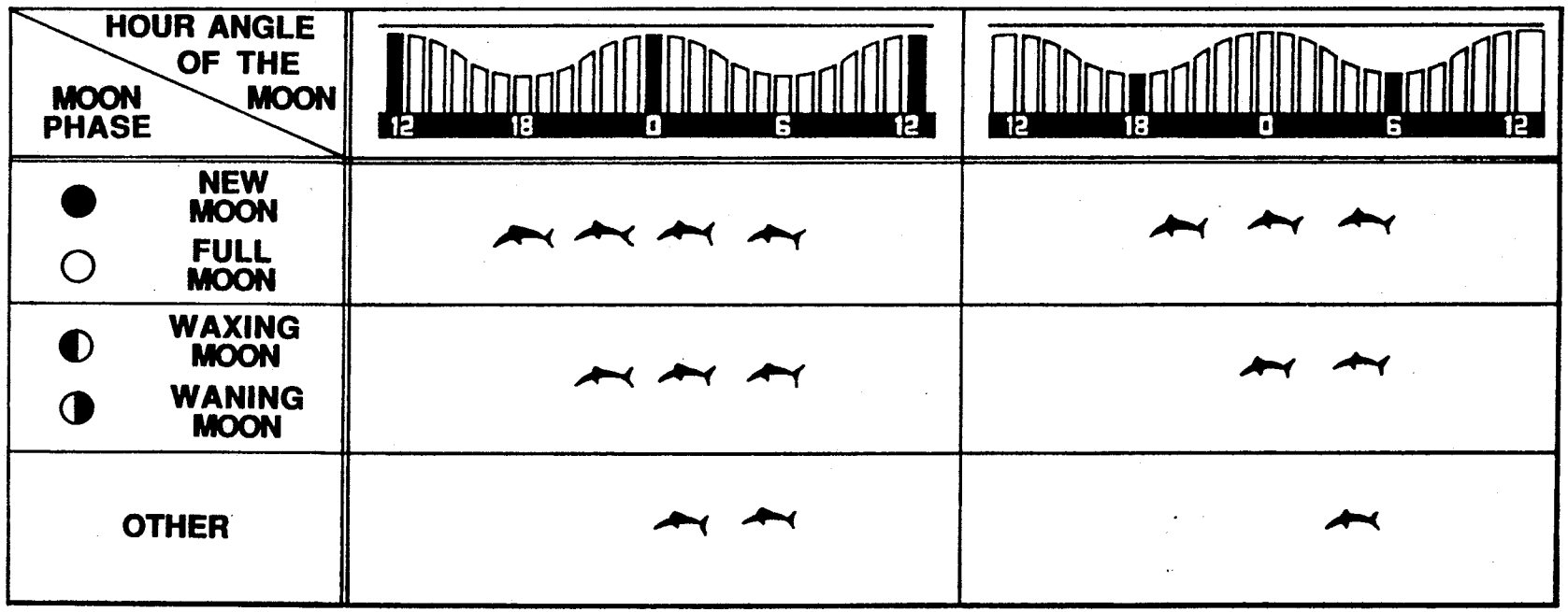
FIG. 17 is a view showing display states of expected catch data obtained from moon phases and hour angle of the moon.

FIG. 17 is a view illustrating an operation performed at Step S131 for deciding number of fish marks to be turned on or displayed. When hour angle of the moon is 0h or 12h, and the moon's age data is within the range 0.0 to 1.8 or 27.7 to 29.5 (new moon) or within the range of 13.0 to 16.0 (full moon) as shown in FIG. 11, data for displaying all of the four fish mark indicating elements *2f* are stored in the registers Q0 and Q2 to indicate a best time for fishing. When the hour angle of the moon is data indicating waning moon or waxing moon, data for displaying three of the four fish mark indicating elements *2f* is stored in the registers Q0 and Q2 to indicate a second best time for fishing. In the same way, data for display process, each corresponding to an hour angle of the moon and moon's age data, are stored in the registers Q0 through Q3, respectively. After completion of the process of Step S131 in FIG. 15, the process advances to Step S132, where a value "1" is set to the flag F2. When a value "1" has been set to the flag F2 at Step S132, the display on the display section 2 is changed from B or I in FIG. 14 to the fishing best time indicating mode shown at G in FIG. 4.

More specifically, when M="1" and F2="1", the display process of FIG. 13 advances from Steps S66 and S67 to Steps S80, S81 and S82, where a value of the register P is discriminated. When P="0", data for turning on or displaying the hour angle indicating element *2c* which corresponds to the hour angle, 0h, out of 25 units of hour angle indicating elements *2c* is transferred to the register A at Step S83. At Step S84, the fish catch forecasting data at the hour angle, 0h, calculated at Step S131 in FIG. 15 and stored in the register Q0 is transferred to the register A. The moon's age data stored in the register U, date data stored in the register E, time data at the hour angle, 0h, stored in the register T0 and numeral data "2" are transferred to the register A at Step S85. Data is transferred to the register A at Step S86, which data decides which one of the moon phase indicating elements *2a* to $2_{a9}$ among the moon's age data stored in the register U should be turned on or displayed. The data transferred to the register A are displayed on the display section 2 at Step S65.

Figure 18:
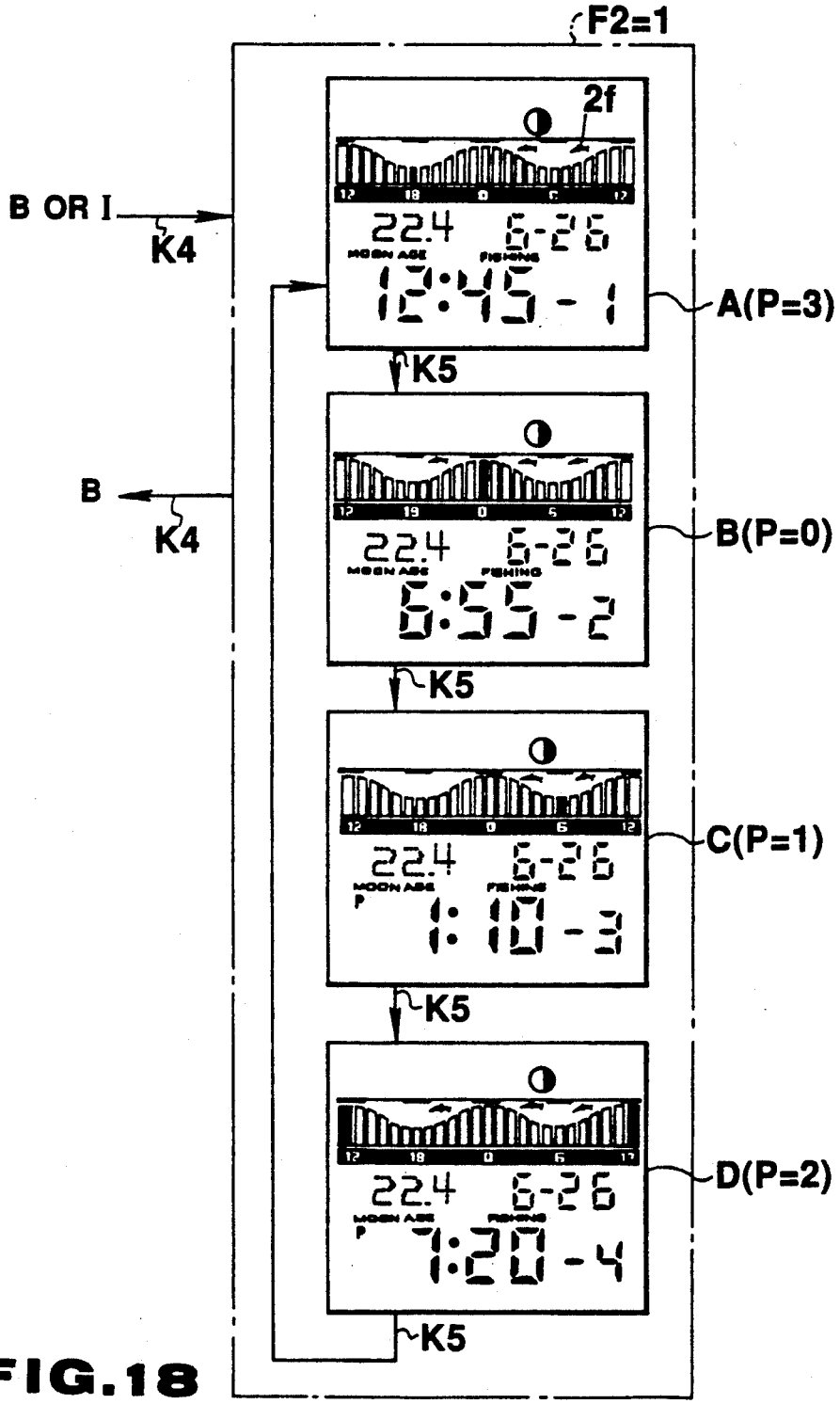
FIG. 18 is a view showing a transition of display states of time information corresponding to a perticular hour angle of the moon.
Figure 19:
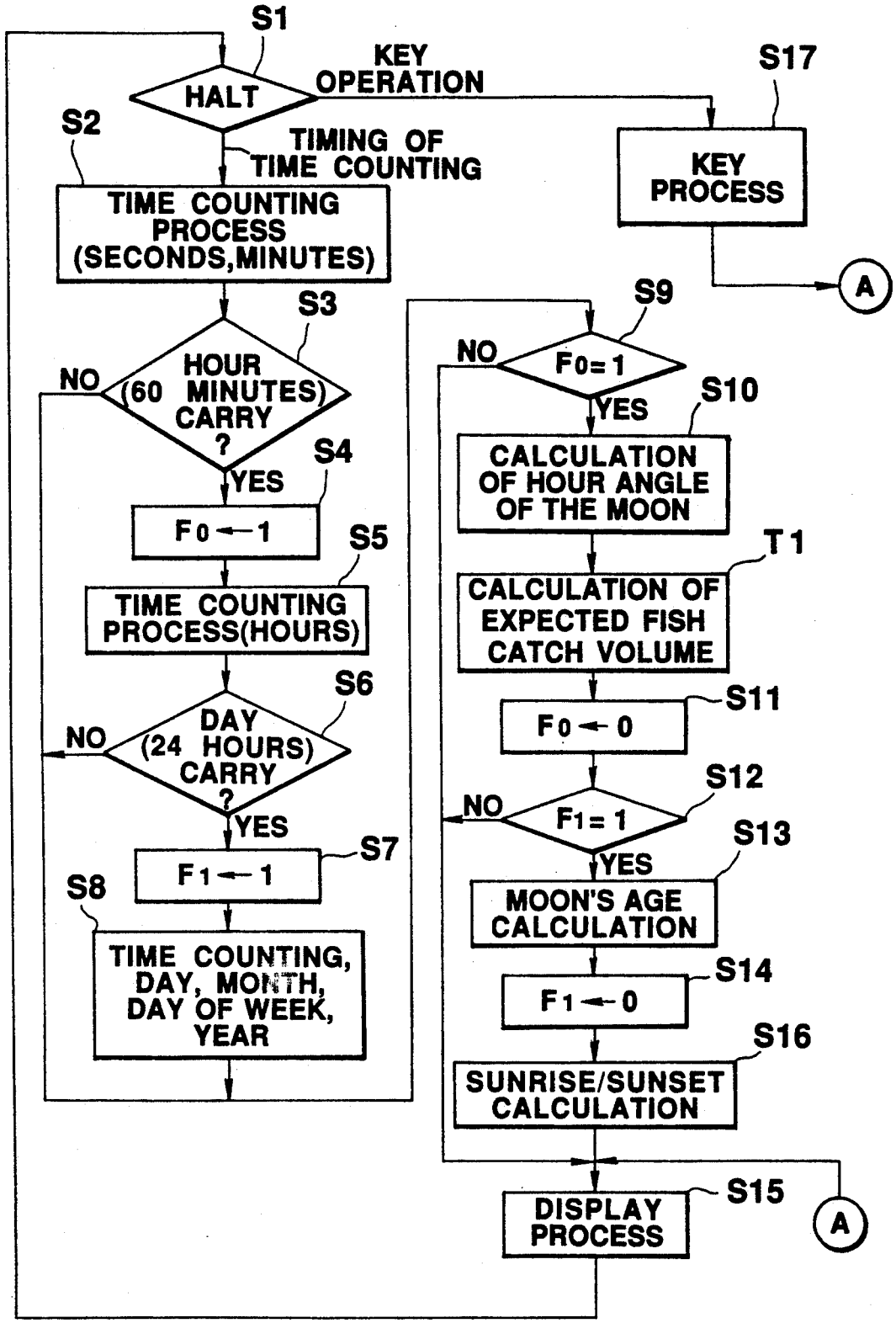
FIG. 19 is a flow chart showing operation of other embodiment of the present invention.

FIG. 18 is a view illustrating transition of the display states in the fishing best time indicating mode at M="1" and F2="1". The register P takes one of values "0", "1", "2" and "3" in accordance with the operation of the switch K5. When P="0", it is indicated as shown at B in FIG. 18 that the time when the hour angle reaches 0h on June 26 is 55 minutes past 6h the moon's age is 22.4, the moon is a waning moon and the fishing catch forecasting data indicates the second best time for fishing (when all of the four fish mark indicating elements *2f* are turned on, the best time for fishing is indicated and meanwhile since three fish mark indicating elements are turned on in the above case, the second best time for fishing is indicated).

When P="1", the process advances from Step S81 to Steps S87, S88 and S89, successively. At Step S78, data to be displayed when the hour angle is 6h is transferred to the register A. When P="2", the process advances from Step S82 to Steps S90, S91 and S92, successively. At Step S90, data to be displayed when the hour angle is 12h is transferred to the register A. When P="3", the process advances to Steps S93, S94 and S95, successively. At Step S93, data to be displayed when the hour angle is 18h is transferred to the register A. More specifically, data for displaying the corresponding hour angle indicating elements 2c are set at Steps S87, S90 and S93, respectively. Fish catch forecasting data at the above hour angles are set at Steps S88, S91 and S94, respectively. Moon'age data, date data, time data corresponding to respective hour angles and numeral data representing the order of display on the display section 2 are transferred to the register A at Steps S89, S92 and S95. As a result, various data at hour angles, 6h, 13h and 18h are displayed as shown at C, D and A in FIG. 18.

In FIG. 15, when it is judged at Step S125 that M="1" is not true, the process advances to Step S133, where it is judged if M="2" is true. When M="2" is true, it is judged at Step S134 if F2="0" is true. When F2="0" is true, the process advances to Steps S135 and S136, where the operation for botaining moon's age and the operation for obtaining sunrise and sunset times are performed. The operation for obtaining moon's age is performed in the same way as shown in FIGS. 10 and 12. But the operation is different from those shown in FIGS. 10 and 12 in that the operation is performed on the basis of the data stored in the register E (the present data or data set by operation of the switch K3) and in that the obtained data are stored int he registers U, X and Y, respectively. At Step S132, F2 is set to "1" and then it is judged at Step S69 in the display process of FIG. 13 if F2 is set to "1". When F2="1" is true, the data stored in the registers U, X and Y are displayed. Accordingly, sunrise and sunset times and moon's age data on the day stored in the register E, date, moon phase and sunrise/sunset mark indicating elements 2b and 2b are displayed as shown at E in FIG. 14. The display state in this case is the same as that shown at D in FIG. 14.

When it is judged at Steps S126 and S134 in FIG. 15 that F2="0" is not true, or when it is judged that F2="1" is true, the process advances to Step S137, where a value "0" is set to the flag F2, and thereby the display states G and H on the display section 2 return to the display states B and E.

When the operation of the switch K2 is detected at Step S138 in FIG. 15, the process advances to Step S139, where it is judged if M="0" is true, and further to Step S140, where it is judged if N="1" is true. When M="0" and N="1" are true, a process is executed at Step S141 for selecting digits to be corrected. More specifically, when the switch K5 is operated in the time correction mode shown at C in FIG. 14, digits involved in the present time data to be corrected are selected successively in order of second, minute and hour. When it is judged at Step S140 that N="1" is not true, it is judged at Step S142 if N="2" is true. When N="2" is true, a process is executed at Step S143 to increment a value of the register L, successively. When the switch K5 is operated in the time difference/longitude/latitue setting mode shown at F in FIG. 16, data to be set is selected successively in order of time difference, longitude and latitude. Further, when it is judged at Step S139 in FIG. 15 that M="0" is not true, the process advances to Step S144, where it is judged if M="1" is true, and to Step S145, where it is judged if F2="1" is true. More specifically, it is judged if the fishing best time indicating mode is set and when M="1" and F="1" are true, a value of the register P is incremented successively at Step S146. Therefore, when the switch K5 is operated in the fishing best time indicating mode, various data at hour angles, 18h, 0h, 6h and 12h are displayed successively, as shown at A, B, C and D in FIG. 18.

Note that when a switch other than the above described switch, for example, a switch K6 is operated, the process advances to Step S147, where other function is effected (not shown).

In the above described embodiment, the operation for obtaining hour angles of the moon is performed every one hour at Steps S3, S4, S9 and S10 of FIG. 10 in the present time display mode shown at A in FIG. 14 and the results are displayed with the indicating elements 2c. Further, the operation for obtaining moon's age and sunrise/sunset times is performed every time when date is changed at Steps S6, S7, S12, S13 and S16 of FIG. 5, and the moon's age data is converted into moon phase data, which is displayed with the indicating elements $2_{a1}$ through $2_{a9}$. Furthermore, when the switch K3 is operated, the sunrise time as well as the sunset time on that day are displayed together with the moon's age and moon phase as shown at D in FIG. 14. The present embodiment has the following features, that is, the data obtained in the embodiment, such as the hour angle of the moon, moon's age, sunrise time and sunset time are extremely precise, because the operation for obtaining these data is performed on the basis of the location data specifying a location on the earth where the present wrist watch is used, such as the longitude and latitude which have been set in the time difference/longitude/latitude setting mode shown at F in FIG. 14 and in addition only algorithm with respect to GMT(Greenwich Mean Time) is required for operations performed in the embodiment, because the above operation is performed with respect to the present time at the location where the wrist watch is used, which present time has been converted into GMT by setting a time difference from GMT. Therefore, the process executed in a very simple way in the embodiment.

Further in the above embodiment, when the switch K1 is operated in the present time display mode shown at A in FIG. 14, the present date is shown on the display section 2 as shown at B in FIG. 14. When the switch K4 is operated while the present date is on display, the best time for fishing on that day is indicated as shown at G in FIG. 14. In the fishing best time indicating mode at G in FIG. 14, the best time for fishing and fish mark indicating elements 2f, number of which represents expected fish catch are displayed on the display section 2 every time the switch K5 is operated as shown in FIG. 18. The user of the wrist watch can conveniently use it, when he plans to go fishing at a best time for fishing.

As shown at I in FIG. 14, when the switch K4 is operated after a desired date has been set by operation of the switch K3, a good time for fishing and expected fish catch are displayed.

Furthermore, when the switch K4 is operated after a desired date has been set by operation of the switch K3 in the state displaying the present date as shown at E in FIG. 14, the sunrise time, the sunset time, moon's age and moon phase on that day are displayed.

The present invention has been described with reference to the embodiment which is applied to a wrist watch. The present invention should not be limited to the above embodiment and it may be installed in a small-sized electronic calculator, a data bank machine, a scheduler and an IC card, and further it may be installed in a particular device for fishing or for hunting.

In addition, the present invention may be installed in a device for indicating hour angles of the moon, moon's age, moon phases and so on. Another embodiment of the invention may be constructed such that time data and location data are input through a keyboard which is provided with a date input key, time input key and key for inputting location on the earth and various operations are performed in terms of the input data as described with reference to the above embodiment.

In the embodiment described above, various operations in a normal time indicating mode for obtaining moon's age, hour angle of the moon and so on are performed once in a day or once in one hour but another embodiment may be constructed such that such various operations may be performed at an interval of less than one hour and, for example, an operation for obtaining hour angle of the moon may be performed every minute.

Still another embodiment may be constructed such that moon data for one month or for one week are calculated at the beginning of month or week and the results are stored in memories, and then the calculated moon data are successively displayed as time lapses.

In the first embodiment described above, the fish catch forecasting is indicated with the four fish mark indicating elements but number of the indicating elements may be increased for more precise indication or digital indicating means may be employed to indicate times for fishing in percent, such that the best time for fishing is expressed with "100%".

FIGS. 19 to 22 are views illustrating yet another embodiment of the present invention. This embodiment will be described hereafter with reference to only its portions different from the above described first embodiment shown in FIGS. 1 through 18.

In the embodiment shown in FIGS. 1 through 18, the best time for fishing on that day or on the preveiously determined day is displayed but in the present embodiment of FIGS. 19 through 22, an expected fish catch volume at the present time on that day is successively displayed as time lapses. Therefore, the process of FIG. 19 includes an additional operation of Step T1 for obtaining data to indicate an expected fish catch volume after Step S10 in the whole processes of FIG. 5. In the operation of Step T1, number of fish mark indicating elements to be turned on is calculated at Step T2 from present hour angle of the moon and moon phase or moon's age, and the result is stored in a register Z. At Step T3 the data stored in the register Z is transferred to a register Q0. In the display process at Step S15 in FIG. 19, the fish mark indicating elements stored in the register Q0 are displayed in the present time indicating mode.

Figure 20:
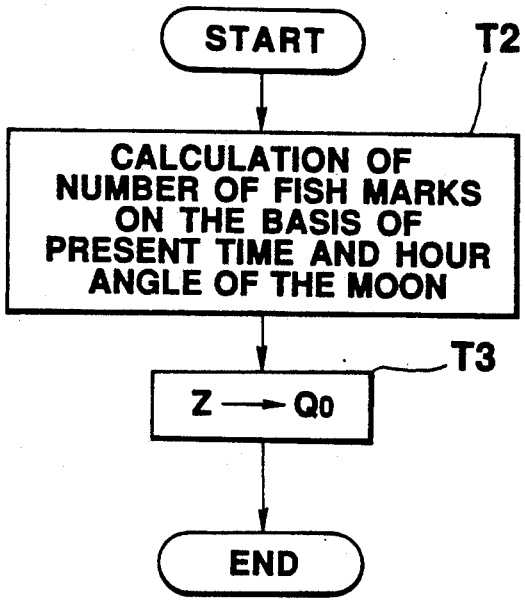
FIG. 20 is a flow chart showing detailed operation to obtain an expected fish catch of FIG. 19.
Figure 21:
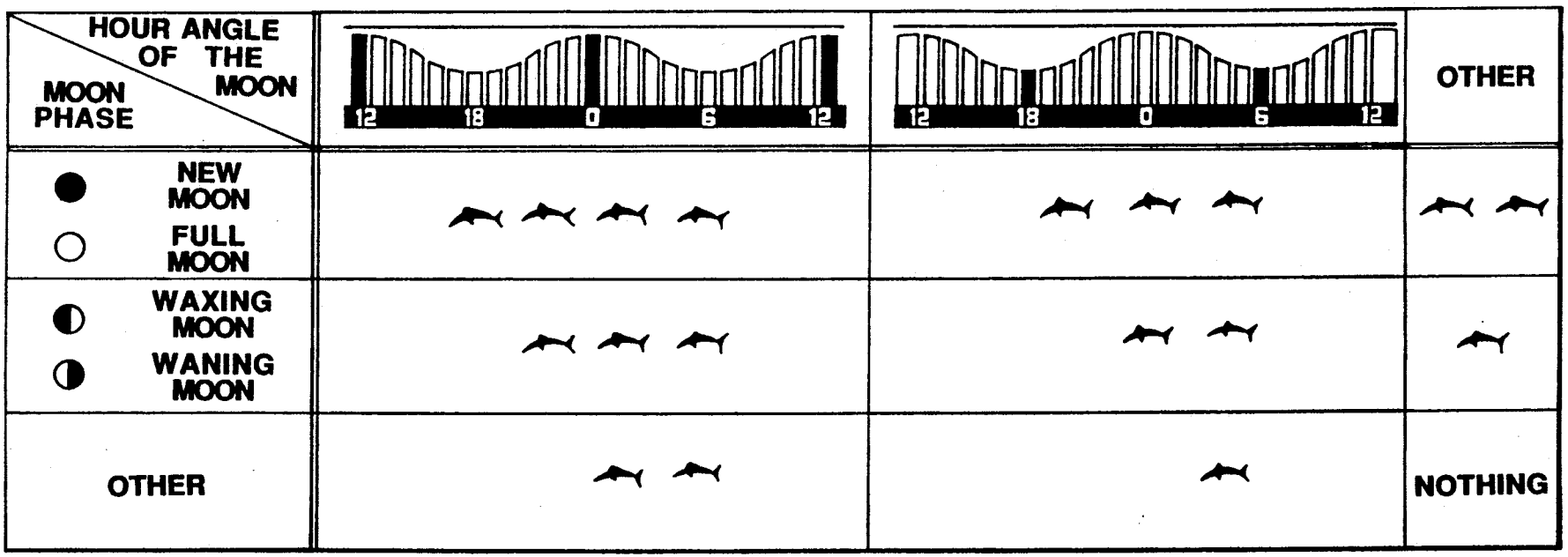
FIG. 21 is a view expected fish catch data obtained from moon phases and hour angle of the moon.

The operation at Step T2 in FIG. 20 for obtaining number of the fish mark indicating elements is as shown in FIG. 21 and different numbers of fish mark indicating elements are obtained by combining moon phases and hour angles of the moon other than those at 0h, 6h, 12h and 18h in addition to the table shown in FIG. 17.

Figure 22:
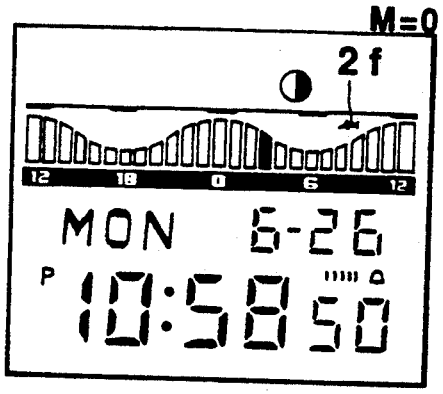
FIG. 22 is a view showing a display state on the display section of the electronic wrist watch.

Accordingly, in the present time indicating mode shown in FIG. 22, only one fish mark indicating element *2f* is dispayed at 58 minutes 50 seconds past 10 o'clock on June 26, and at the same time an expected fish catch volume is also indicated.

The embodiment which is capable of indicating expected fish catch volume together with the present time may be provided with a feature which functions to generate an alarm when the best time for fishing is reached or when all of the fish mark indicating elements *2f* are turned on. Further, the embodiment may be proivded with a feature which functions to generate different alarm sounds each time when the expected fish catch volume is changed.

In the above embodiments, time difference from GMT, longitude, latitude are set, but a world watch is well known which is capable of indicating cities around the world as well as the times at these cities and the present invention may be applied to this type of watch, thereby indicating moon data for these cites. For example, New York is at 74 degrees of longitude and 41 degrees of latitude and the time difference from GMT is minus 5 hours. Therefore, still another embodiment may be constructed such that longitude data, latitude data and time difference from GMT for various cities are stored, for example, in ROM, and when, for example, New York is designated on the world watch and time at New York is indicated, hour angle of the moon, moon phase, sunrise time and sunset time are calculated from the data stored in ROM and the present time at New York, and these data thus calculated are displayed.

In further another embodiment, a world watch may be constructed such that longitude data and latitude data for various cities are displayed, and these data are changed, and thereby moon data for an area in the vicinity of these cities are obtained.

As having been described above, the present invention is not limited to the above embodiments but may be used in various manners, any may be also used to obtain locations of various planets other than the moon or locations of fixed stars.

What is claimed is:

1. A device for providing a forecasted catch size of a certain animal at a given time, comprising:

location data means for providing location data representing a specified location on the earth;

time data means for providing time data including time of day data and data data at said specified location;

hour angle data calculation means for calculating hour angle data of the moon at the specified location based on said location data and said time data;

moon data means for providing moon data based on said time data;

means for converting said hour angle data and said moon data to an output signal corresponding to a forecasted catch size of the certain animal; and a display including a first indicating portion for said time data, and a second indicating portion having means responsive to said output signal of the converting means for providing a visual indication of the forecasted catch size corresponding to said time data.

2. The device of claim 1, wherein said moon data includes at least one of moon phase data and moon's age data.

3. The device of claim 2, wherein said display includes a third indicating portion for said moon data.

4. The device of claim 3, wherein said display includes a fourth indicating portion for said hour angle data.

5. The device of claim 4, further comprising means for controlling said display to indicate simultaneously on said second, third and fourth indicating portions the forecasted catch size, the moon phase data, and the hour angle data, respectively.

6. The device of claim 5, wherein said control means controls said display to indicate the moon's age data on said third indicating portion simultaneously with said forecasted catch size, the moon phase data, and the hour angle data.

7. The device of claim 6, wherein said fourth indicating portion of the display comprises a plurality of parallel, elongated elements each of which corresponds to a selected hour angle, with the total number of all said elements corresponding to a total of 24 hour angles.

8. The device of claim 7, wherein said plurality of elements are of variable lengths to form a group of sequential depressed elements between two groups of sequential elevated elements, said second indicating portion of the display being juxtaposed with said depressed group of elements so as to fit substantially between said groups of elevated elements.

9. The device of claim 8, wherein said second indicating portion includes a number of indicia each of which is independently displayable in response to said output signal of the converting means for indicating the forecasted catch size, with a best catch size being forecasted when all of said number of indicia are displayed.

10. The device of claim 9, wherein said control means controls said display to indicate the time data on said first indicating means simultaneously with the forecasted catch size, the moon's age data, the moon's phase data and the hour angle data.

11. The device of claim 4, wherein said control means controls the display to indicate simultaneously on said second, third and fourth indicating portions the forecasted catch size, the moon's age data, and the hour angle, respectively.

12. The device of claim 1, wherein said display includes a further indicating portion comprising a plurality of parallel, elongated elements each of which corresponds to a selected hour angle, with all of said elements corresponding to a total of 24 hour angles.

13. The device of claim 12, wherein said plurality of elements are of variable lengths to form a group of sequential depressed elements being two groups of sequential elevated elements, said second indicating portion of the display being juxtaposed with said depressed group of elements so as to fit substantially between said groups of elevated elements.

14. The device of claim 13, wherein said second indicating portion includes a number of indicia each of which is independently displayable in response to said output signal of the converting means for indicating the forecasted catch size, with a best catch size being forecasted when all of said number of indicia are displayed.

15. The device of claim 4, wherein said control means controls said display to indicate the time data on said first indicating means simultaneously with the forecasted catch size, the moon's age data, the moon's phase data and the hour angle data.

16. A device for providing a forecasted catch size of a certain animal at a given time, comprising:

location data means for providing location data representing a specified location on the earth;

time data means for providing time data including time of day data and date data at said specified location;

hour angle data calculation means for calculating hour angle data of the moon at the specified location based on said location data and said time data;

moon data means for providing moon data based on said time data;

means for converting said hour angle data and said moon data to an output signal corresponding to a forecasted catch size of the certain animal;

a display; and means for controlling said display to provide a visual indication of a forecasted catch size responsive to said output signal of the converting means.

17. The device of claim 16, wherein said control means controls the display to provide a visual indication of said time data simultaneously with its corresponding forecasted catch size.

18. The device of claim 16, wherein said control means controls the display to provide a visual indication of said forecasted catch size simultaneously with its corresponding time data and moon data.

19. The device of claim 16, wherein said control means controls the display to provide a visual indication of said forecasted catch size simultaneously with its corresponding time data, moon data and hour angle data.

* * * * *